US007923081B2

(12) United States Patent
Matsuura et al.

(10) Patent No.: US 7,923,081 B2
(45) Date of Patent: Apr. 12, 2011

(54) RECORDING MEDIUM FOR WATER-BASED INK AND METHOD FOR DETERMINING INK ABSORBING CHARACTERISTIC THEREOF

(75) Inventors: Satoshi Matsuura, Tokyo (JP); Naho Ishida, Tokyo (JP); Kenichi Yamaguchi, Tokyo (JP); Hitoshi Nagashima, Tokyo (JP); Sadayuki Sugama, Tokyo (JP)

(73) Assignees: Oji Paper Co., Ltd., Tokyo (JP); Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 11/631,177

(22) PCT Filed: Aug. 30, 2006

(86) PCT No.: PCT/JP2006/317597

§ 371 (c)(1),
(2), (4) Date: Dec. 28, 2006

(87) PCT Pub. No.: WO2007/026939

PCT Pub. Date: Mar. 8, 2007

(65) Prior Publication Data

US 2008/0233317 A1 Sep. 25, 2008

(30) Foreign Application Priority Data

Aug. 31, 2005 (JP) ..... 2005-252385

(51) Int. Cl.
*B41M 5/40* (2006.01)

(52) U.S. Cl. ..... 428/32.18; 428/32.21; 428/32.28; 428/32.29; 428/32.3; 428/32.31; 428/32.34

(58) Field of Classification Search ..... 428/32.18, 428/32.21, 32.28, 32.29, 32.3, 32.31, 32.34
See application file for complete search history.

(56) References Cited

U.S. PATENT DOCUMENTS

| | | | | |
|---|---|---|---|---|
| 5,180,624 | A * | 1/1993 | Kojima et al. | 428/32.19 |
| 5,429,860 | A * | 7/1995 | Held et al. | 428/32.3 |
| 2004/0166252 | A1 * | 8/2004 | Takashima et al. | 428/32.1 |

FOREIGN PATENT DOCUMENTS

| | | |
|---|---|---|
| JP | 7-242082 | 9/1995 |
| JP | 11-198523 | 7/1999 |
| JP | 2000-79752 | 3/2000 |
| JP | 2000-263926 | 9/2000 |
| JP | 2001-88439 | 3/2001 |
| JP | 2001-130129 | 5/2001 |
| JP | 2003-103916 | 4/2003 |

* cited by examiner

*Primary Examiner* — Betelhem Shewareged
(74) *Attorney, Agent, or Firm* — Dilworth & Barrese, LLP.

(57) ABSTRACT

A mat type recording medium for ink jet printing is provided which exhibits optimum printability no matter which of dye ink and pigment ink may be used in printing. The recording medium, which is for recording with use of water-based ink containing an ink colorant, comprises a paper base and an ink receptive layer formed on a surface of the paper base, the ink receptive layer comprising a porous layer containing an inorganic pigment and also containing a substance reactive with the ink colorant.

24 Claims, 3 Drawing Sheets

RECORDING MEDIUM FOR WATER-BASED INK AND METHOD FOR DETERMINING INK ABSORBING CHARACTERISTIC THEREOF

FIELD OF THE INVENTION

The present invention relates to a recording medium for water-based ink, the recording medium having a paper base and an ink receptive layer, as well as a method for determining an ink absorbing characteristic of the recording medium. Particularly, the present invention is concerned with a mat type recording medium for water-based ink, the recording medium having a relatively low gloss suitable for ink jet printing.

BACKGROUND

Recently, printing using water-based ink for preparing a hard copy at high speed has been performed in offset printing and letterpress printing and importance is being attached to the characteristics of a recording medium. Particularly, with the technical advance of ink jet printers, it has become possible to obtain clear images and superior print quality. At the same time, a demand exists for a recording medium having higher characteristics in order to further improve the print quality. To meet this demand, various recording media have been developed.

On the other hand, the use of water-based ink jet printers has spread and such printers are in use also for advertisement such as posters. In such a use, not only such recording characteristics as high image quality and high recording density are needed, but also it is necessary to keep images clear in long-term bulletin or storage. Heretofore, water-based dye inks superior in color developing property have been used as inks for ink jet printers. Generally, however, water-based dye inks are apt to fade when exposed to light and the clearness thereof is lost with the lapse of time. Thus, water-based dye inks have so far been unsuitable for long-term bulletin or storage. In an effort to solve such a problem, the number of printers and plotters using water-based pigment inks superior in light resistance is now increasing.

However, water-based pigment inks are different in characteristics from water-based dye inks for example because of the fact that the pigments used in the water-based pigment inks are particulate. Consequently, recording media to be respectively used exclusively for such two types of inks have been provided and at present there is scarcely any recording medium suitable for both types of inks.

Generally, recording media for pigment inks are designed to enhance their ink absorbing property, while in the case of recording media for dye inks, the ink absorbing property thereof is set lower than that of the recording media for pigment inks, but instead there is selected a suitable ink fixing agent. Thus, water-based dye inks and water-based pigment inks have characteristics contrary to each other, so if inks and recording media are used in erroneous combinations, there eventually are obtained only recorded matters impaired in quality such impracticable image density or blotting. For example, when printing is performed using pigment ink onto a conventional recording medium for water-based dye ink, the pigment ink is not absorbed and there occurs a phenomenon such as unevenness or cracking in the printed portion, thus giving rise to a problem in practical use.

Recording media for water-based ink are broadly classified into a gloss type high in the degree of gloss, a mat type low in the degree of gloss, and a plain paper type having a texture almost close to that of wood-free paper. Gloss type recording media are classified into a type using resin-coated paper used as a base of silver salt photographic printing paper and a type using paper. In both types, a fine particle diameter distribution is narrow and a coating layer can be formed using a pigment which can ensure transparency, making both absorbability and gloss compatible with each other. In case of recording something on a gloss type recording medium out of these recording media, the absorption of ink is slow because an ink receptive layer is formed on the recording medium with use of a fine pigment, and therefore the recording speed is decreased to a recording speed in a printer, thereby suppressing the occurrence of ink blotting. This eventually means that the printing speed is low and that therefore the printer capacity is not exhibited to a satisfactory extent.

Particularly, in the case of a mat type recording medium, since it is designed mainly for improving the ink absorbing property, there is used a pigment much larger in particle diameter than the pigment used in the gloss type, resulting in that the degree of gloss is made low. As a recording medium further improved in such excellent ink absorbing property there is known one wherein the surface of a paper base is subjected to a surface treatment for improving a solvent passing characteristic, thereby accelerating a rapid flow of liquid in a boundary region between an ink receptive layer and a paper base. Anyhow, since the mat type recording medium is large in the diameter of pigment particles, it is higher in ink absorbing speed than the gloss type and it is said that its recording speed in a printer can be set high. Recently, however, with the spread of digital cameras, the recording of full-color images has come to be performed not only for the gloss type but also for the mat type of recording media. Consequently, the amount of ink per unit area increases in comparison with that in recording monochromatic images, thus creating a demand for further improved ink absorbing characteristics. However, an attempt to meet this demand gives rise to the problem that there occur color tastes and blotting of various colors.

As noted above, under the present situation wherein a recording medium suitable for both water-based dye ink and water-based pigment ink, both being different in absorption characteristic, has not been provided yet, it may be effective to adopt a recording medium improved in recordability by forming plural ink receptive layers such as the one disclosed Patent Literature 1 or 2. However, a recording medium fully satisfactory in absorption characteristic for both water-based dye ink and pigment ink has not been provided yet.

OBJECTS OF THE INVENTION

It is an object of the present invention to review conventional recording media for water-based ink, clarify the reason why proper images are not obtained, establish the relation between a paper base and an ink receptive layer, which relation is regarded as being difficult to make clear, as a quantitative or qualitative technique, and thereby provide a recording medium for water-based ink which permits the formation of a desired image without the production of many samples. It is another object of the present invention to provide a recording medium having optimum printability for both water-based dye ink and water-based pigment ink, which has been unachievable in the prior art, as well as a method for determining the printability using the water-based inks without performing printing.

In more particular terms, it is a first object of the present invention to provide a novel recording medium for both water-based dye ink and water-based pigment ink which recording medium can ensure the development of color and the uniformity of density of a "solid image."

It is a second object of the present invention to provide a criterion easy to understand and able to determine an ink absorbing characteristic which a novel recording medium for water-based ink should possess.

It is a third object of the present invention to provide a recording medium for water-based ink, the recording medium having a unique liquid absorbing characteristic necessary for forming a desired image.

It is a fourth object of the present invention to provide a recording medium for water-based ink, the recording medium permitting formation of a clear image even with an increase in weight of a paper base used therein.

It is a fifth object of the present invention to provide a mat type recording medium for water-based ink, the recording medium permitting formation of an image having a feeling of depth so far unobtainable.

In the present invention, at least one of these objects is to be achieved. However, as will be apparent from the following description, the present invention further contributes to solving other problems.

SUMMARY OF THE INVENTION

In an effort to achieve the above-mentioned objects the present inventors have studied, using an optical electron microscope, whether there is a relation to an ink absorbing characteristic with respect to conventional paper base, ink receptive layer, and boundary region between the paper base and the ink receptive layer. However, it has been difficult to recognize the said relation qualitatively or quantitatively. In connection with a method for clearly representing conventional recording media characteristics, the present inventors have noticed that a principal component of water-based ink is pure water, and studied how pure water behaves during absorption thereof into a recording medium. In the actual ink jet recording, an ink droplet in the range of 2 to 8 picoliter is used. In view of this point the present inventors have measured absorption of one microliter of pure water, but it has been impossible to make the behavior of pure water clear because of too rapid absorption. Subsequent many experiments conducted by the present inventors led to determination of an absorption characteristic of four microliter of pure water permitting determination of characteristics of conventional recording media.

Results of having determined absorption characteristics of recording surfaces of conventional recording media for water-based ink are shown as J, K, L and M in Table 1 and are also shown in FIG. 1 (J, K, L and M represent absorption characteristics of conventional recording media for water-based ink and the axis of abscissa represents the amount of absorption, while the axis of ordinate represents the time after dropping). As is seen also from FIG. 1, the conventional recording media indicated by the symbols J and K have a period of little liquid absorption over a long period and thus exhibit a result that a substantially overflowing ink disturbs an image, with correlation being recognized between the two. Such a phenomenon is presumed to be of the following mechanism. The recording medium for water-based ink according to the present invention is of a three-layer structure having a boundary region of a high density endowed with a filter function as a boundary region between a paper base and an ink receptive layer. On the other hand, the conventional recording media indicated by the symbols J and K are of a two-layer structure wherein a paper base and an ink receptive layer are merely joined together, and it is presumed that such an absorption characteristic as referred to above is exhibited because the filter function based on the paper base-ink receptive layer interface is too strong.

In the recording medium indicated by the symbol M, the absorption of ink is done in an extremely short time and this is correlated with the result of a marked lowering of print density. As a mechanism of this phenomenon it is presumed that there scarcely exists any boundary region having a filter function based on interface because the amount of a binder component contained in the ink receptive layer is small and that therefore a one-layer structure is dominant although the recording medium in question is of a two-layer structure having a paper base and an ink receptive layer. This is presumed to be the reason why such an absorption characteristic is exhibited.

The recording medium indicated by the symbol L lies between the above two and is improved in characteristics over the recording media K and J, but the spread of dot and the density is not sufficient, with correlation being recognized therein. This is presumed to be due to the following mechanism. An ink receptive layer having a small content of a binder component is dried at a low temperature for a long time, resulting in that the binder component penetrates the whole of a paper base and a boundary region having a filter function based on the paper base-ink receptive layer interface is formed at a low density. Therefore, a one-layer structure is dominant although the recording medium in question is actually of a two-layer structure. This is presumed to be the reason why such an absorption characteristic is exhibited.

Thus, the determination conditions in the present invention are fully significant quantitatively and/or qualitatively for the characteristics of the conventional recording media. On the basis of this knowledge the present inventor have investigated conditions of a recording medium able to achieve the objects of the present invention and eventually accomplished the present invention.

In the determining method according to the present invention, a droplet of 4 μl distilled water is dropped onto the surface of an ink receptive layer of a recording medium for water-based ink, the recording medium having a paper base and the ink receptive layer, the ink receptive layer being provided on the surface of the paper base and containing amorphous silica, an adhesive and a substance reactive with an ink colorant, and the droplet is absorbed in a first absorbing stage of absorbing the droplet at a first absorbing speed V1 (μl/sec) within one second just after the dropping, a second absorbing stage of absorbing the droplet at a second absorbing speed V2 (μl/sec) after the first absorbing stage, and a third absorbing stage of absorbing the droplet at a third absorbing speed (μl/sec) after the second absorbing stage. Then, an absorption characteristic of the recording medium is determined, assuming that an inflection point from the first absorbing stage V1 to the second absorbing stage V2 is a, an inflection point from the second absorbing stage V2 to the third absorbing stage is b, a final point of the third absorbing stage V3 is c, absorption quantities at the inflection points a, b and c are qa, qb and qc, and the times up to those points are ta, tb and tc.

The absorbing speeds V1, V2 and V3 as referred to herein indicate joining the inflection points and the final point, corresponding to approximate straight lines in the absorbing stages derived from measured values.

The inflection points as referred to herein indicate a point of change from the absorbing speed V1 to V2 and a point of change from the absorbing speed V2 to V3. In the case where the change from V1 to V2 and the change from V2 to V3 have a gently changing inflection region, for example a line is dropped from a point of intersection of extended straight lines of V1 and V2 is dropped perpendicularly to an approximate curve of the inflection region and the resulting point of intersection is the inflection point.

Generally, it is said that for suppressing unevenness or the like of a paper base which is apt to occur at the time of application of a coating material there should be used a paper base high in Stöckigt sizing degree. Conversely, the present inventors have tried to use a paper base low in Stöckigt sizing degree and further tried to use acid paper although neutral paper with little discoloration is usually employed, in point of pH of the paper base.

Anyhow, on the basis of the thinking that the ink receptive layer or the base material itself is important for attaining an excellent quality, the present inventors have made studies about the properties each constituent. As a result of extensive studies the present inventors found out that the influence of each constituent was not dominant, but a "filter function" in a boundary region between the ink receptive layer and the paper base was dominant.

FIGS. 2 and 3 show absorption characteristics of conventional recording media for water-based ink and recording media for water-based ink according to the present invention.

The symbols A, B, C, D, E, F, G, H and I in FIG. 2 graphically represent measurement results set forth in Table 1 which will be shown later, while the symbols N, O, P, Q, R, S, T, U, V and W in FIG. 3 graphically represent measurement results set forth in Table 3 which will be shown later, both showing absorption characteristics of the water-based ink recording media according to the present invention.

As is seen also from Tables 1 to 4 and FIGS. 2 and 3, the absorption characteristics of the water-based ink recording media according to the present invention are distinctly different from the conventional water-based ink recording media. Also from a comparison of actually printed matters the present inventors have made sure that the printed matters printed on the recording media according to the present invention are most superior in print quality and found out that there is a correlation between the absorption characteristics shown in FIGS. 1 to 3 and actual images.

As a result of having determined absorption characteristics with use of droplets of 1 to 7 μl distilled water, the present inventors found out that the use of the 4 μl droplet brought about the most distinct difference in absorption characteristics.

Having made further earnest studies to investigate properties of all constituents including the ink receptive layer and the paper base, the present inventors found out that the absorbing speed of the recording medium for water-based ink should satisfy specific conditions, and accomplished the present invention related to both the recording medium for water-based ink and the method for determining an ink absorbing characteristic of the recording medium for water-based ink, as described below.

The present invention resides in the following:

(1) A recording medium for water-based ink, comprising a paper base and an ink receptive layer formed on a surface of the paper base, the ink receptive layer comprising a porous layer containing an inorganic pigment and also containing a substance reactive with an ink colorant, the recording medium being to be recorded using water-based ink containing the ink colorant, characterized in that a droplet of 4 μl distilled water dropped onto a surface of the ink receptive layer is absorbed in a first absorbing stage of absorbing the droplet at a first absorbing speed V1 (μl/sec) within one second after the dropping, a second absorbing stage of absorbing the droplet at a second absorbing speed V2 (μl/sec) for at least 2 seconds after the first absorbing stage, and a third absorbing stage of absorbing the droplet at a third absorbing speed V3 (μl/sec) after the second absorbing stage, the droplet absorption in the first to third absorbing stages satisfying the following relationships:

$$0<V2<V1$$

$$0<V2<V3,$$

the second absorbing speed V2 (μl/sec) being higher than 0.01 (μl/sec) and lower than (0.32 μl/sec), and given that an inflection point from the first to the second absorbing stage is a, an inflection point from the second to the third absorbing stage is b, a final point of the third absorbing stage is c, absorption quantities at the points a, b and c are qa, qb and qc, respectively, and the times up to the points a, b and c are ta, tb and tc, respectively, the absorption quantity qa at the inflection point, a, is not smaller than 1.3 μl and smaller than 2.0 μl, and the absorption quantity qb at the inflection point, b, is not smaller than 2.0 μl and smaller than 2.5 μl.

(2) A recording medium for water-based ink as set forth in (1), wherein the inflection point, a, occurs within 0.5 second after the dropping.

(3) A recording medium for water-based ink as set forth in (1), wherein the absorption quantity (qb−qa) in the second absorbing stage is not smaller than 0.3 ml and not larger than 1.2 μl.

(4) A recording medium for water-based ink as set forth in (1), wherein the absorption quantity (qb−qa) in the second absorbing stage is not smaller than 0.5 μl and not larger than 1.0 μl.

(5) A recording medium for water-based ink as set forth in (1), wherein the absorption quantity qa at the inflection point, a, is not smaller than 1.5 μl.

(6) A recording medium for water-based ink as set forth in (5), wherein the weight of the recording medium is not less than 180 g/m$^2$ and not more than 300 g/m$^2$, and the inflection point, b, occurs within 8 seconds after the dropping.

(7) A recording medium for water-based ink as set forth in any of (1) to (6), wherein the paper base has a Stöckigt sizing degree of not shorter than 5 seconds and not longer than 50 seconds.

(8) A recording medium for water-based ink as set forth in any of (1) to (6), wherein the ink receptive layer has a $pH_B$ satisfying the following relationship:

$$5<pH_B\leqq 7$$

(9) A recording medium for water-based ink as set forth in (8), wherein the paper base has a $pH_A$ and the ink receptive layer has the $pH_B$ both satisfying the following relationship:

$$1<(pH_B-pH_A)<4$$

(10) A recording medium for water-based ink as set forth in any of (1) to (6), wherein the second absorbing speed V2 (μl/sec) is higher than 0.05 (μl/sec) and lower than 0.23 (μl/sec).

(11) A recording medium for water-based ink as set forth in any of (1) to (6), wherein the second absorbing speed V2 (μl/sec) is higher than 0.12 (μl/sec) and lower than 0.23 (μl/sec).

(12) A recording medium for water-based ink, comprising a paper base, the paper base having a Stöckigt sizing degree of not shorter than 5 seconds and not longer than 50 seconds, and an ink receptive layer formed on a surface of the paper base, the ink receptive layer containing amorphous silica, an adhesive and a substance reactive with an ink colorant, characterized in that a droplet of 4 μl distilled water dropped onto a surface of the ink receptive layer is absorbed in a first absorbing stage of absorbing the droplet at a first absorbing speed V1 (μl/sec) within one second after the dropping, a second absorbing stage of absorbing the droplet at a second absorbing speed V2 (μl/sec) for at least 2 seconds after the first absorbing stage, and a third absorbing stage of absorbing the droplet at a third absorbing speed V3 (μl/sec) after the second absorbing stage and within 8 seconds after the dropping, the droplet absorption in the first to third absorbing stages satisfying the following relationship:

$$0<V2<V3<V1,$$

the second absorbing speed V2 (μl/sec) being higher than 0.01 (μl/sec) and lower than 0.32 (μl/sec), and given that an inflection point from the first to the second absorbing stage is a, an inflection point from the second to the third absorbing stage is b, a final point of the third absorbing stage is c, absorption quantities at the points a, b and c are qa, qb and qc, respectively, and the times up to the points a, b and c are ta, tb and tc, respectively, the absorption quantity qa at the inflection point, a, is not smaller than 1.5 μl and not larger than 2.0 μl and the absorption quantity (qb−qa) in the second absorbing stage is not smaller than 0.3 μl and not larger than 1.0 μl.

(13) A recording medium for water-based ink as set forth in (12), wherein the ink receptive layer has a $pH_B$ satisfying the following relationship:

$$5<pH_B\leqq 7,$$

the paper base has a $pH_A$ and the ink receptive layer has the $pH_B$ both satisfying the following relationship:

$$1<(pH_B-pH_A)<4,$$

the ink receptive layer has a thickness of, not smaller than 25 μm and not larger than 35 μm, and the weight of the paper base and the ink receptive layer is in the range of not smaller than 180 g/m$^2$ and not larger than 300 g/m$^2$.

(14) A recording medium for water-based ink as set forth in (12) or (13), wherein the second absorbing speed V2 (μl/sec) is higher than 0.12 (μl/sec) and lower than 0.23 (μl/sec).

(15) A recording medium for water-based ink to be recorded using water-based ink containing an anion colorant, the recording medium having on a surface of a paper base an ink receptive layer, the ink receptive layer comprising a porous layer containing an inorganic pigment and a substance reactive with the ink colorant, characterized in that a droplet of 4 μl distilled water dropped onto a surface of the ink receptive layer is absorbed in a first absorbing stage of absorbing the droplet at a first absorbing speed V1 (μl/sec) within one second after the dropping, a second absorbing stage of absorbing the droplet at a second absorbing speed V2 (μl/sec) for not shorter than 2 seconds after the first absorbing stage, and a third absorbing stage of absorbing the droplet at a third absorbing speed V3 (μl/sec) after the second absorbing stage, the droplet absorption in the first to third absorbing stages satisfying the following relationships:

$$0<V2<V1$$

$$0<V2<V3,$$

the second absorbing speed V2 (μl/sec) being higher than 0.01 (μl/sec) and lower than 0.32 (μl/sec), and given that an inflection point from the first to the second absorbing stage is a, an inflection point from the second to the third absorbing stage is b, a final point of the third absorbing stage is c, absorption quantities at the points a, b and c are qa, qb and qc, respectively, and the times up; and to the points a, b and c are ta, tb and tc, respectively, the absorption quantity qa at the inflection point, a, is not smaller than 1.3 μl and not larger than 2.0 μl, and the absorption quantity (qb−qa) in the second absorbing stage is not smaller than 0.3 μl and not larger than 1.0 μl.

(16) A recording medium for water-based ink as set forth in (15), wherein the second absorbing speed V2 (μl/sec) is higher than 0.05 (μl/sec) and lower than 0.23 (μl/sec).

(17) A recording medium for water-based ink as set forth in (16), wherein the paper base has a Stöckigt sizing degree of not shorter than 5 seconds and not longer than 50 seconds.

(18) A recording medium for water-based ink, comprising a paper base and an ink receptive layer formed on a surface of the paper base, the ink receptive layer containing amorphous silica, an adhesive and a substance reactive with an ink colorant, characterized in that a droplet of 4 μl distilled water dropped onto a surface of the ink receptive layer is absorbed in a first absorbing stage of absorbing the droplet at a first absorbing speed V1 (μl/sec) within one second after the dropping, a second absorbing stage of absorbing the droplet at a second absorbing speed V2 (μl/sec) for at least 2 seconds after the first absorbing stage, and a third absorbing stage of absorbing the droplet at a third absorbing speed V3 (μl/sec) after the second absorbing stage, the droplet absorption in the first to third absorbing stages satisfying the following relationships:

$$0<V2<V1$$

$$0<V2<V3,$$

the second absorbing speed V2 (μl/sec) being higher than 0.01 (μl/sec) and lower than 0.32 (μl/sec), and given that an inflection point from the first to the second absorbing stage is a, an inflection point from the second to the third absorbing stage is b, a final point of the third absorbing stage is c, absorption quantities at the points a, b and c are qa, qb and qc, respectively, and the times up to the points a, b and c are ta, tb and tc, respectively, the absorption quantity qa at the inflection point, a, is not smaller than 1.3 μl and smaller than 2.0 μl, the absorption quantity qb at the inflection point, b, is larger than the absorption quantity qa in the first absorbing stage and smaller than 2.5 μl, and the absorption quantity (qb−qa) in the second absorbing stage is not smaller than 0.3 μl and not larger than 1.4 μl.

(19) A recording medium for water-based ink as set forth in (18), wherein the absorption quantity (qb−qa) in the second absorbing stage is not smaller than 0.38 μl and not larger than 1.0 μl.

(20) A recording medium for water-based ink as set forth in (19), wherein the absorption quantity qa at the inflection point, a, is not smaller than 1.5 μl.

(21) A recording medium for water-based ink as set forth in (18), wherein the second absorbing stage occurs within not shorter than 2.0 seconds and not longer than 13.5 seconds after the dropping of the droplet.

(22) A recording medium for water-based ink as set forth in (21), wherein the time tc in the third absorbing stage is within 14.1 seconds after the dropping of the droplet.

(23) A recording medium for water-based ink as set forth in (20), wherein the second absorbing stage occurs within 6.1 seconds after the dropping of the droplet and the time tc up to the final point in the third absorbing stage occurs within 8 seconds after the dropping of the droplet.

(24) A recording medium for water-based ink as set forth in (19), wherein the second absorbing stage occurs at or after 9.5 seconds from the dropping of the droplet and the time tc up to the final point in the third absorbing stage occurs within 14.5 seconds after the dropping of the droplet.

(25) A recording medium for water-based ink as set forth in any of (18) to (24), wherein the second absorbing speed V2 (μl/sec) is higher than 0.05 (μl/sec) and lower than 0.23 (μl/sec).

(26) A recording medium for water-based ink as set forth in (23), wherein the second absorbing speed V2 (μl/sec) is higher than 0.12 (μl/sec) and lower than 0.23 (μl/sec).

(27) A recording medium for water-based ink as set forth in (24), wherein the second absorbing speed is higher than 0.05 (μl/sec) and lower than 0.09 (μl/sec).

(28) A method for determining an ink absorbing characteristic of a recording medium for water-based ink, the recording medium comprising a paper base and an ink receptive layer formed on a surface of the paper base, the ink receptive layer containing amorphous silica, an adhesive and a substance reactive with an ink colorant, the method comprising determining:

that a droplet of 4 μl distilled water dropped onto a surface of the ink receptive layer in the recording medium for water-based ink is absorbed in a first absorbing stage of absorbing the droplet at a first absorbing speed V1 (μl/sec) within one second after the dropping, a second absorbing stage of absorbing the droplet at a second absorbing speed V2 (μl/sec) for at least 2 seconds after the first absorbing stage, and a third absorbing stage of absorbing the droplet at a third absorbing velocity V3 (μl/sec) after the second absorbing stage;

that the second absorbing speed V2 (μl/sec) is higher than 0.01 (μl/sec) and lower than 0.32 (μl/sec); and that an inflection point, a, from the first to the second absorbing stage, an inflection point, b, from the second to the third absorbing stage, and a final point, c, of the third absorbing stage are determined, and given that absorption quantities at the points a, b and c are qa, qb and qc, respectively, and the times up to the points a, b and c are ta, tb and tc, respectively, the absorption quantity qa in the first absorbing stage is not smaller than 1 μl and smaller than 2.0 μl, the absorption quantity qb in the second absorbing stage is larger than the absorption quantity qa in the first absorbing stage and smaller than 2.5 μl, and the absorption quantity (qb−qa) in the second absorbing stage is not smaller than 0.3 μl and not larger than 1.4 μl.

(29) A method for determining an ink absorbing characteristic of a recording medium for water-based ink as set forth in (28), wherein the second absorbing speed V2 (μl/sec) is higher than 0.05 (μl/sec) and lower than 0.23 (μl/sec).

(30) A method for determining an ink absorbing characteristic of a recording medium for water-based ink as set forth in (28), wherein the weight of the paper base and the ink receptive layer is in the range of not less than 180 g/m$^2$ and not more than 300 g/m$^2$, and the second absorbing speed V2 (μl/sec) is higher than 0.12 (μl/sec) and lower than 0.23 (μl/sec).

As to the recording medium according to the present invention it is preferable that the conditions described in the above aspects be satisfied as a whole. However, even if there exists one point slightly deviated from the conditions due to a certain unexpected cause such as the presence of dust, such a case is included in the present invention insofar as the effect obtained by carrying out the present invention is substantially obtained as a whole. Also in the case of cut paper or long paper such as machine-glazed paper, it is preferable for such paper to fall under the scope of the present invention throughout the whole portion thereof, provided even paper not wholly falling under the scope of the present invention is regarded as being included in the present invention if the present invention is applied substantially to a main portion of the paper.

EFFECT OF THE INVENTION

According to the present invention, a filter function able to make a substantially liquid penetrated state appropriate in a boundary region between an ink receptive layer and a paper base, which function has heretofore been unattainable, is attained mainly by the second absorbing stage. More particularly, the greatest feature of the present invention resides in the presence of the second absorbing stage wherein such an action as association or aggregation of colorant portions is brought about while a predetermined amount (a factor dominating the image density; in the present invention, 1.3 to 2 μl, preferably 1.5 μl or more, in the foregoing 4 μl distilled water) of liquid penetrated into the ink receptive layer is moved moderately in the scope satisfying a condition (e.g., the absorbing speed V2 in the second absorbing stage) defined in each of the above aspects of the invention. The second absorbing stage exhibits an excellent effect in improving the image density and in a blotting suppressing action. It is presumed that at the inflection point of the final region in this sage there is brought about an action corresponding to forming an optimum fixed state of colorant within the ink receptive layer. At this inflection point there starts the third absorbing stage wherein a rapid absorption of an ink droplet to the paper base is performed, thereby permitting diffusion of solvent and moisture which have become unnecessary. It is presumed that a substantial solid-liquid separating function is exhibited. Thus, it is apparent that the present invention is an excellent invention having a new filter function in the boundary region between the ink receptive layer and the paper base unlike such a conventional boundary surface as a mere joined surface of two layers of a paper base and an ink receptive layer.

Anyhow, according to the present invention, since the second absorbing stage permitting moderate absorption of water-based ink is provided, not matter which of water-based dye ink and water-based pigment ink may be used in printing over a wide range of 130 to 300 g/m$^2$ in terms of the weight of the recording medium for water-based ink, it is possible to minimize blotting and afford a clear image of a high density superior in solid uniformity. Moreover, by applying the present invention to a mat type recording medium it is possible to afford an image having a feeling of depth by printing. Other effects of the present invention will be understood from the following description.

PREFERRED EMBODIMENTS OF THE INVENTION

<First Invention>

In the first invention described in the foregoing item (1), the absorbing speeds in the first to third absorbing stages are determined in the following manner. A droplet of 4 μl (microliter) distilled water (23° C.) is dropped from a height of about 1 cm onto a surface of an ink receptive layer in a recording medium for water-based ink after left standing 24 hours in an environment of 23° C., 50% RH, using a microsyringe and using a Dynamic Absorption Tester (DAT) (a product of Fibro Co.), in an environment of 23° C., 50% RH, then the contour of the dropped droplet is photographed using a video camera, the volume of the droplet is determined by the analysis of the image obtained, and both absorption quantity and absorption time are determined from a change in volume with the lapse of time. The volume calculation is performed in accordance with the following equation:

$$V\,(\text{volume})=\pi H(0.75B^2+H^2)\div 6$$

where H stands for height and B stands for the diameter of the droplet.

Just after the dropping, the change in volume of the droplet is large and therefore it is preferable to shorten the measurement interval like 0.02 second.

In printers of various companies or even in printers of the same company there are used inks of different compositions, so in evaluation made in the present invention there is used distilled water (23° C.) as a standard liquid. In the dropping of several pl (picoliter) used frequently in the recent printers, it is impossible to make a satisfactory evaluation because of instantaneous absorption of the ink. Moreover, printing of a photographic image or the like onto a mat type recording medium for water-based ink is performed using plural colors (e.g., six colors) and that at a higher speed than in gloss type printing, with a consequent increase in the amount of ink used. The present invention is based on the finding that the evaluation of absorbability on the surface of an ink receptive layer, in the interior of the ink receptive layer, in a boundary interface portion between the ink receptive layer and a paper base and further in the paper base portion is coincident with a change in absorbing speed under 4 μl dropping.

As to the absorbing speeds V1, V2 and V3, for example as shown in FIG. 2, an absorption quantity for each time is plotted. In this case, a gradient becomes an absorbing speed. The absorbing speed may change at every interval of plotting, but in the present invention large changes in absorbing speed are designated V1, V2 and V3 respectively. That is, the absorbing speed may increase or decrease slightly at V1, V2 and V3. In the present invention, a colorant-solvent separating function in ink during recording is judged by determining large changes in absorbing speed.

A further explanation will now be given with reference to FIGS. 2 and 3. Conventional recording media for water-based ink present such values as J, K, L and M, all representing absorptions of 0<V2<V1 and 0<V2<V3. The recording medium K, which is available commercially as a mat type recording medium for water-based ink, has a long V2 period of 16.6 seconds, thus exhibiting a behavior such that the absorption does proceed in quick tempo. In the case of the recording medium L available commercially as a mat type recording medium for water-based ink, the absorption quantity qa in the first absorbing stage is 1.07 μl, then in the subsequent second absorbing stage the absorption quantity of 1.44 μl is attained in a little shorter than 5 seconds. Further, the recording medium M available commercially as a recording medium for pigment ink has a short V2 period of 0.6 second and thus terminates absorption in an instant.

Having pursued ink absorbing characteristics corresponding to excellent recordability for both pigment ink and dye ink, the present inventors found out that the recording media exhibiting ink absorbing characteristics represented by the symbols A to I and N to W were superior. Particularly, the recording media which exhibit ink absorbing characteristics satisfying the relationships of 0<V2<V1 and 0<V2<V3 are preferred.

In the first absorbing stage, an ink droplet is absorbed at the first absorbing speed (V1) within one second after the dropping mainly on the surface of the ink receptive layer, the absorbing speed being the highest among the three stages. By increasing this speed it is possible to separate ink colorant and solvent from each other on the surface of the ink receptive layer or within the same layer. Particularly, in the case of pigment ink, by separating a colorant and a solvent at an early stage, the aggregation of the colorant is accelerated and it is possible to attain a high density recording. Also in the case of dye ink, a solvent is separated rapidly from the dye and thus it is possible to prevent blotting of the ink, which is preferable. If the absorbing speed in this stage is lower than in the other stages, there occurs blotting of ink on the surface of the ink receptive layer.

If the ink absorption quantity in the first absorbing stage is too large, the amount of ink contributing to the effect in the second and third absorbing stages becomes deficient, and if the ink absorption quantity is too small, the amount of ink contributing to the effect in the second and third absorbing stages becomes too large. Therefore, it is optimum that the absorption quantity qa in the first absorbing stage be larger than 1.3 μl and smaller than 2.0 μl. A too small absorption quantity qa results in a lowering of the solid image uniformity, while a too large absorption quantity qa results in a lowering of image density.

The second absorbing stage is carried out at the second absorbing speed (V2) after the first absorbing stage. The absorption of ink in the second stage corresponds to absorption which proceeds until a part of the liquid having penetrated into the ink receptive layer begins to penetrate from the surface of the paper base to the interior of the paper base. It is optimum that this stage have a period of 2 seconds or longer. If the period is shorter than 2 seconds, since there is no spread of ink in the interior or on the surface of the ink receptive layer, a dot deficient in its spread results, further, there occurs unevenness in density and the solid image uniformity is deteriorated. For obtaining a dot of a satisfactory spread it is preferable that the ink absorption quantity (qb−qa) in this second stage be not smaller than 0.3 μl and be not larger than the absorption quantity in the first stage. If the ink absorption quantity in this second stage is smaller than 0.3 μl, the spread of the resulting dot is insufficient, while if it exceeds the absorption quantity in the first absorbing stage, the absorption of ink to the paper base becomes large relative to the dot spread and so there is a tendency that unevenness in density is apt to occur.

Particularly, an ink absorption quantity (qb−qa) of not smaller than 0.5 μl at the second absorbing speed V2 brings about a good effect. The third absorbing stage comprises absorption to the interior of the paper base.

The first invention defines an absorption characteristic of the recording medium for water-based ink and does not specially limit how to prepare the recording medium.

In FIG. 2, recording media for water-based ink were prepared using a coating solution for forming the same ink receptive layer on different base materials, and the resulting recording medium using a paper base having a Stöckigt sizing degree of 15 seconds is represented by symbol A, while the resulting recording medium using a paper base having a Stöckigt sizing degree of 50 seconds is represented by symbol B. A comparison of the two shows that the symbol A (the paper base of 15 seconds) is the shorter with respect to the time in the second absorbing stage. When a comparison is made with symbol C which uses a different coating solution for an ink receptive layer on the same paper base and which uses silica containing little fine component although an average particle diameter of amorphous silica is almost the same, it is seen that the second absorbing stage is the shorter in symbol A which uses silica containing a fine component.

It is known that usually the absorbing speed of the ink receptive layer is high and that of the paper base is low. It is also known that the smaller the value of Stöckigt sizing degree, the higher the absorbing speed. Probably, the absorption characteristic of the first invention is a phenomenon resulting from the use of amorphous silica as is recognized also in the prior art. In the present invention, when forming an ink receptive layer on the paper base, voids are formed by pulp-pulp or pulp-filler present near the surface of the paper base and the adhesive component penetrates and the amorphous silica component is filled into the voids, whereby an absorption characteristic controlling function is presumed to be imparted to the boundary portion between the paper base and the ink receptive layer. By penetration of the adhesive component it is possible to make the time of the second absorbing stage long and the filling of the amorphous silica acts as a beginning of ink absorption to the interior of the paper base, which is presumed to make a shift to the third absorbing stage.

The reason why the symbol C using silica containing little fine component is the longer in the time of the second absorbing stage than the symbol A using silica containing a fine component is presumed to be because a chance for ink absorption to the interior of the paper base is insufficient.

The absorbing speed in the first absorbing stage permits the use of amorphous silica as in the prior art, but can be adjusted by controlling the content of amorphous silica.

The absorbing speed in the second absorbing stage can be adjusted by changing the binder content in the boundary interface region between the ink receptive layer and the paper base. More specifically, a relatively large content of an ink receptive layer component (binder) is needed, which can be attained by increasing the proportion of the binder in the ink receptive layer. The adjustment can also be made by changing drying conditions.

Moreover, by lowering the Stöckigt sizing degree of the paper base, the absorbing speed in the third absorbing stage can be adjusted to as to become higher.

It is preferable that the Stöckigt sizing degree of the paper base be not lower than 5 seconds and not higher than 50 seconds.

Further, since the color developing mechanism on the recording medium differs between the case where the colorant used is a dye and the case where the colorant used is a pigment, it is preferable that $pH_B$ which represents the pH of the ink receptive layer be set at:

$$5<pH_B\leqq 7$$

The reason is that an excellent color developing property is attained in both dye ink and pigment ink.

Particularly, there is a tendency that an excellent color developing property is attained when $pH_A$ which represents the pH of the paper support and $pH_B$ of the ink receptive layer satisfy the following relationship:

$$1<(pH_B-pH_A)<4$$

The above condition can be satisfied for example by adjusting the conditions for preparing the paper base or by adjusting the coating solution for forming the ink receptive layer.

The thickness of the ink receptive layer is not specially limited, but particularly preferably it is not smaller than 25 μm and not larger than 35 μm. For example, when the thickness of the ink receptive layer is 25 μm or more, it is possible to ensure a required ink absorption quantity in a printer for drawing a color balance with use of inks of six or more colors. However, if the thickness of the ink receptive layer is larger than 35 μm, the recording density using dye ink becomes lower and the film strength is deteriorated when viewed from another viewpoint.

The mat type recording medium for water-based ink is low in gloss and one mainly available on the market is not more than 15% in terms of a gloss value at 75°. However, this gloss value does not constitute any limitation in the present invention.

<Various Materials>

The recording medium for water-based ink described above can be produced by combining selection of a paper base, selection of constituents of an ink receptive layer and selection of a method for forming the ink receptive layer.

(Paper Base)

As examples of pulp used as a main component of the paper base there are mentioned chemical pulps such as LBK and NBKP, mechanical pulps such as GP and TMP, and waster paper recycled pulps. These pulps may be used as mixtures of two or more. Above all, it is preferable to use LBKP as a main pulp component. It is also preferable to use chlorine-free pulps such as ECF pulp and TCF pulp. The degree of beating is not specially limited, but it is preferable that beating be done so as to give a freeness of not lower than 300 ml and not higher than 500 ml (CSF: JIS-P-8121). With an increase of the degree of beating, the cockling tends to become worse in printing, but unevenness in dyeing also tends to occur easily, while if the degree of beating is low, there is a tendency that smoothness is not attained.

Not only the pulp but also a filler may be incorporated in the paper base. The filler is used for the purpose of adjusting the air permeability of the paper base, thereby imparting opacity to the paper base or adjusting the ink absorbing property. Examples of employable fillers include clay, kaolin, calcined kaolin, talc, calcium carbonate, magnesium carbonate, aluminum hydroxide, calcium hydroxide, silica, and titanium oxide. Above all, calcium carbonate is preferred because it affords a paper base having a high degree of whiteness.

It is preferable that the content of the filler be not less than 1 part by mass and not more than 35 parts by mass relative to 100 parts by mass of the entire pulp. If the filler content is low, there is a tendency that not only the degree of whiteness becomes lower, but also the ink absorbability is deteriorated. A too high filler content tends to result in a lowering of stiffness and of paper power.

The Stöckigt sizing degree of the paper base used in the recording medium for water-based ink according to the present invention is adjusted by using for example any of internal sizing agents such as rosin sizes, alkenyl succinic anhydride, alkyl ketene dimer and petroleum resin sizes, as well as surface sizes such as rosin sizes, petroleum resin sizes, starches, e.g., oxidized starch, acetylated starch and hydroxyethylated starch, derivatives thereof, polyvinyl alcohols and derivatives thereof, synthetic resins comprising compolymers of two or more of styrene, alkyd, polyamide, acryl, olefin, maleic acid and vinyl acetate, and their synthetic resin emulsions and waxes.

The Stöckigt sizing degree of the paper base is determined in accordance with JIS P 8122 and is preferably in the range of 5 to 50 seconds. If the Stöckigt sizing degree is less than 5 seconds, a component contained in the coating material of the ink receptive layer penetrates into the paper base or the binder component contained in the coating material penetrates into the base material, so that the surface strength of film becomes weak. This is probably the reason why it is impossible to obtain the effect of improvement in color developability with respect to both dye ink and pigment ink even if the ink receptive layer according to the present invention is formed. If the Stöckigt sizing degree exceeds 50 seconds, the water resistance of a printed portion is deteriorated.

The paper making method is not specially limited. The paper can be produced using a known paper machine such as, for example, a Fourdrinier paper machine, a cylinder paper machine, or a twin wire paper machine. Both acid paper and neutral paper are employable, depending on the pH of the raw material used for paper making. It is preferable that the material exhibit a specific $pH_A$, and the use of acid paper is preferred.

With use of a size press or the like, for example starch, a polyvinyl alcohol or a cation resin may be applied and penetrated to the paper surface to adjust the surface smoothness and improve the surface smoothness and printability and writability. Further, the paper base may be subjected to a smoothing treatment using a calender or the like in order to enhance its smoothness. It is possible to adjust $pH_A$ by the application of a pH adjusting material. Preferably, the weight of the paper base is not smaller than 130 $g/m^2$ and not larger than 300 $g/m^2$.

(Ink Receptive Layer)

The ink receptive layer contains at least an inorganic pigment, an adhesive, and a substance reactive with an ink colorant, e.g., a cationic ink fixing agent.

Examples of employable inorganic pigments include clay, kaolin, calcined kaolin, talc, calcium carbonate, magnesium carbonate, aluminum hydroxide, calcium hydroxide, amorphous silica, and titanium oxide.

Above all, amorphous silica is preferred as an inorganic pigment because it is superior in color developability and ink absorbability as compared with other pigments. How to prepare amorphous silica is not specially limited. Amorphous silica produced by any of arc process, dry process and wet process (precipitation process, gelation process) is employable. But wet process silica is preferred because it is suitable for both a recording medium for water-based pigment ink and a recording medium for water-based dye ink.

An average particle diameter of secondary particles of amorphous silica is not specially limited if it permits the formation of the ink receptive layer in the recording medium for water-based ink which satisfies the absorption characteristic defined in the present invention, but is preferably not larger than 10 μm, more preferably not smaller than 4 μm and not larger than 8 μm. If the average particle diameter of secondary particles in amorphous silica exceeds 10 μm, there is a tendency that problems such as the deterioration of image clearness, conspicuous surface roughness and unevenness in printing are apt to occur in both the case of a recording medium for water-based dye ink and a recording medium for water-based pigment ink. If the average particle diameter is smaller than 4 μm and when such amorphous silica is used in a recording medium for water-based dye ink, the absorbability of the dye ink tends to be deteriorated. As the amorphous silica particles become still finer, the ink transmittance of the ink receptive layer becomes higher, so there occurs a tendency that the light resistance in recording using the dye ink is deteriorated or the film strength becomes lower. Also in case of using such amorphous silica particles in a recording medium for water-based pigment ink, the fixing property of the pigment ink tends to become deteriorated.

The average particle diameter of silica as referred to herein is determined by a coulter counter method and represents a volume average particle diameter determined using silica as a sample which is dispersed by ultrasonic dispersion in distilled water for 30 seconds.

It is particularly preferred that the amorphous silica having such an average particle diameter of secondary particles have a broad (the range of 1 to 9 μm as a guideline) particle size distribution and include fine particles able of enter between pulp fibers on the paper base surface. Usually, the binder component contained in the ink receptive layer and a cation resin component penetrate and partially coat the paper base surface at the boundary portion between the ink receptive layer and the paper base of the recording medium for water-based ink thus formed. Besides, the absorbing speed of the paper base alone is very high in comparison with that of the ink receptive layer. In such a paper base, the absorbing speed becomes very low and the ink solvent cannot be absorbed smoothly into the paper base. That is, such an absorbing speed as in the present invention is not exhibited in many cases. Fine silica particles get into gaps formed between pulp fibers on the paper base surface at the boundary portion between the ink receptive layer and the paper base in the recording medium for water-based ink thus formed. This is presumed to increase the absorbing speed of the paper base and creates an ink solvent absorption assisting action of the paper base. This action is effective in suppressing an excessive spread of a dropped ink droplet. As the speed of ink absorption to the paper base becomes lower, there occurs a tendency that the ink droplet concerned spreads to an excessive degree and the lowering of recording density and blotting are apt to occur.

The adhesive used in the ink receptive layer is not specially limited. Known hydrophilic adhesives usually employed for recording media are employable. Examples are proteins such as casein, soy protein and synthetic protein, starches such as starch and oxidized starch, polyvinyl alcohols and derivatives thereof, cellulose derivatives such as carboxymethyl cellulose and methyl cellulose, conjugated diene resins such as styrene-butadiene resin and methyl methacrylate-butadiene copolymer, acrylic resins as polymers or copolymers of acrylic acid, methacrylic acid, acrylic esters and methacrylic esters, and vinyl resins such as ethylene-vinyl acetate copolymer. These adhesives may be used each alone or in combination of two or more.

Above all, polyvinyl alcohols are superior in their adhesion to pigments and are therefore preferable. Polyvinyl alcohol derivatives such as silanol-modified polyvinyl alcohol and cationized polyvinyl alcohol are also employable.

The silica-adhesive ratio is such that the adhesive is used in an amount of not smaller than 30 parts by mass and not larger than 70 parts by mass, preferably not smaller than 40 parts by mass and not larger than 60 parts by mass, based on 100 parts by mass of silica. If the amount of the adhesive used is large, the penetrating speed becomes lower, while if it is small, the amount of the adhesive present in the boundary region between the paper base and the ink receptive layer becomes short and it becomes impossible to adjust the absorption characteristic. If the amount of the adhesive is small to the extreme degree, the strength of the ink receptive layer tends to become low.

On the other hand, the substance reactive with the ink colorant used in the ink receptive layer is not specially limited. Particularly preferred is a cationic ink fixing agent. The following, which are available commercially, are mentioned as examples of the cationic ink fixing agent: (1) polyalkylene polyamines such as polyethylene polyamine and polypropylene polyamine, and derivatives thereof, (2) acryl polymers having a secondary amino group, a tertiary amino group or a quaternary ammonium group, (3) polyvinylamine, polyvinylamidine, and five-membered ring amidines, (4) dicyan-based cation resins typified by dicyandiamide-formalin copolymer, (5) polyamine-based cation resins typified by dicyandiamide-polyethyleneamine copolymer, (6) dimethylamine-epichlorohydrin copolymer, (7) diallyldimethyl ammonium-$SO_2$ copolymer, (8) diallylamine salt-$SO_2$ copolymer, (9) dimethyldiallylammonium chloride polymer,

(10) allylamine salt polymer, (11) homopolymer or copolymer of vinylbenzyltriallyl ammonium salt, (12) dialkylaminoethyl(meth)acrylate quaternary salt copolymers, (13) acrylamide-diallylamine copolymer, and (14) aluminum salts such as polyaluminum chloride and polyaluminum acetate. These cationic ink fixing agents may be used each alone or in combination of two or more.

It is preferable that the acrylamide-diallylamide copolymer and the diallyldimethyl ammonium chloride be used in combination. The reason is that such a combination use brings about an excellent color developing property when recording is made using a pigment ink and brings about excellent color developing property and shelf life when recording is made using a dye ink. The reason for such an improvement of the color developing property is presumed to be because the colorant in each in can be fixed into the ink receptive layer without being agglomerated.

The content of the cationic ink fixing agent is preferably not less than 5 parts by mass and not more than 60 parts by weight based on 100 parts by mass of the pigment used. More preferably, it is adjusted in the range of 20 to 50 parts by mass. If the content of the ink fixing agent is less than 5 parts by mass, the clearness of image is apt to be deteriorated, and if it exceeds 60 parts by mass, the appearance after coating is apt to be deteriorated.

To the ink receptive layer there may be added, as necessary, various additives used in the conventional coated paper manufacture such as thickener, defoaming agent, wetting agent, surfacant, coloring agent, antistatic agent, light resistance aid, ultraviolet absorber, antioxidant, and antiseptic. By the porous layer is meant a layer wherein pores are present on the surfaces of inorganic pigment particles or gaps or voids are present between particles, even if the layer contains a water-soluble adhesive.

The amount of coating of the ink receptive layer is not specially limited, but is preferably not smaller than 10 $g/m^2$ and not larger than 20 $g/m^2$. If the amount of coating is smaller than the said lower limit, the clearness of image is apt to be deteriorated, while if it is larger than the above upper limit, the film strength and image clearness are apt to become lower when viewed from another viewpoint. The ink receptive layer may be formed as a laminate of plural layers and in this case the ink receptive layer composition may be different between the layers.

The ink receptive layer may be formed using any of various coaters such as blade coater, air knife coater, roller coater, bar coater, gravure coater, rod blade coater, lip coater, curtain coater, and die coater.

Conditions for drying the ink receptive layer are adjusted for example by changing the concentration of the ink receptive layer coating solution. The behavior of the absorbing speed varies also depending on drying conditions. It is preferable to adopt as strong drying conditions as possible, but excessive drying tends to deteriorate the color developing property. After the coating there may be performed a finishing treatment using a calender such as machine calender, super calender, or soft calender. However, since such a treatment results in the voids present in the ink receptive layer surface being crushed, so it is preferable to make adjustment so that the absorbing speed does not depart from the specified range.

<Second to Fourth Inventions>

The absorbing speed determining method in the second invention described in the above item (12) is the same as that in the first invention. In the second invention it is preferable that V1, V2 and V3 satisfy the relation of 0<V2<V3<V1.

The absorption quantity qa in the first absorbing stage is set at a value of not smaller than 1.5 μl and not larger than 2.0 μl and the absorption quantity (qb−qa) in the second absorbing stage is set at a value of not smaller than 0.3 μl and not larger than 1.0 μl. Such an absorption characteristic permits promotion solid-liquid separation and ensuring a sufficient spread of ink.

In the second invention it is important that the absorption of ink in the second stage be carried out moderately. This means positive execution of ink absorption in the portion where the ink colorant is to be fixed.

In the third invention described in the above item (15), the absorbing speed determining method is the same as that in the first invention. In the third invention it is preferable that V1, V2 and V3 satisfy the relations of 0<V2<V1 and 0<V2<V3. The absorption quantity qa in the first absorbing stage is set at a value of not smaller than 1.0 μl and not larger than 2.0 μl and the absorption quantity (qb−qa) in the second absorbing stage is set at a value of not smaller than 0.3 μl and not larger than 1.0 μl.

By satisfying such an absorption characteristic it is possible to promote solid-liquid separation and ensure a sufficient spread of ink.

Also in the third invention it is important that the liquid absorption in the second stage be carried out moderately. This means positive execution of ink absorption in the portion where the ink colorant is to be fixed. In terms of a numerical value it is preferable that the absorption quantity (qb−qa) in that period be in the range of 0.3 to 1.0 μl, more preferably 0.5 to 1.4 l. The range of 0.3 (or 0.5) to 1.0 μl is preferred in practical use.

In the fourth invention described in the above item (18), the absorbing speed determining method is the same as in the first invention. In the fourth invention, the absorption quantity qa in the first absorbing stage is set at a value of not smaller than 1.3 μl and smaller than 2.0 μl and the absorption quantity qb in the second absorbing stage is set at a value of larger than the absorption quantity qa in the first absorbing stage and smaller than 2.5 μl. Further, the absorption quantity (qb−qa) in the second absorbing stage is set at a value of not smaller than 0.3 μl and not larger than 1.4 μl. By satisfying such an absorption characteristic it is possible to promote solid-liquid separation and ensure a sufficient spread of ink.

Also in the fourth invention it is important that the liquid absorption in the second stage be carried out moderately. This means positive execution of ink absorption in the portion where the ink colorant is to be fixed. In terms of a numerical value it is preferable that the absorption quantity (qb−qa) in that period be in the range of 0.3 to 1.4 μl, more preferably 0.5 to 1.4 μl. The range of 0.3 (or 0.5) to 1.0 μl is preferred in practical use.

The second to fourth inventions pay attention to the behavior of ink absorption and make no special limitation except that water-based ink containing an anion colorant and that the recording medium for water-based ink has a porous layer containing an inorganic pigment and a substance reactive with the ink colorant. Suitable known bases, inorganic pigments, cationic compounds and binders are employable. The porous layer plays a role mainly as an ink receptive layer.

It is preferable that the pH of the porous layer be larger than 5 and not larger than 7 and that the porous layer have an underlying pulp layer as an ink absorbing layer, the pH of the pulp layer being smaller than that of the porous layer. Further, it is preferable that the Stöckigt sizing degree of the paper base be not less than 5 seconds and not more than 50 seconds.

EXAMPLES

The present invention will be described below in more detail by way of working Examples thereof, but it goes without saying that the invention is not limited thereto. Parts and % in the following Examples are of solids exclusive of water and represent parts by mass and mass %, respectively, unless otherwise mentioned.

Stöckigt sizing degrees of paper bases, as well as print densities and print water resistances of recording media for water-based ink, obtained in the following Examples and Comparative Examples were evaluated by the following methods.

For evaluation, printing to recording media for water-based ink was performed by means of a commercially available ink jet printer using pigment ink, (trademark: Image PROGRAF W6200, a product of Canon Inc., printing mode: thick coated paper/high quality) and a commercially available ink jet printer (trademark: PIXUS ip8600, a product of Canon Inc., printing mode: mat photopaper/high quality).

[Stöckigt Sizing Degree]

The Stöckigt sizing degree of each paper base was determined in accordance with JIS P 8122.

[Print Density]

An image ( "a high-definition color digital standard image XYZ/JIS-SCID," Identification symbol: S6, Image name: Color Chart) published by a foundation, Japanese Standard Association was printed using two types of printers—Image PROGRAF W6200 (using pigment ink) and PIXUS ip8600 (using dye ink)—and a print density was determined from highest color tone portions of black and magenta by means of RD-914 (a product of Guretag Macbeth Co.).

[Blotting]

With respect to a print obtained using two types of printers—Image PROGRAPH W6200 and PIXUS ip86000—, blotting of the print in a black-red boundary portion was evaluated visually.

Criterion:

◎: no blotting of print, excellent level

○: a little blotting of ink, but not causing any problem in practical use

Δ: a little blotting of ink, somewhat causing a a problem in practical use

×: marked blotting of ink, causing a serious problem in practical use

[Image Uniformity]

Black print portions from the two types of printers—Image PROGRAF W6200 and PIXUS ip8600—were checked visually and evaluated in accordance with the following criterion:

◎: excellent solid uniformity, an image having a feeling of depth, high grade

○: good solid uniformity, good grade

Δ: somewhat poor solid uniformity

×: bad

Example 1

[Paper Base I]

10 parts of calcined kaolin was added to 100 parts of hard wood bleached kraft paper (freeness 400 ml, CSF: JIS-P-8121), further added were 1.0 part of cation starch, 0.7 part of a rosin size and 2.0 parts of alum cake, followed by mixing to a thorough extent to prepare a raw material for paper making. Then, using a Fourdrinier multi-cylinder type paper machine, paper making was performed, followed by drying to a water content 10%. Then, with a size press, a 7% aqueous solution of oxidized starch was applied 4 g/m$^2$ to both paper surfaces, followed by drying to a water content of 5.0%, thereby affording a paper base I having a weight of 190 g/m$^2$ and a Stöckigt sizing degree of 15 seconds.

[Preparing a Coating Solution for an Ink Receptive Layer]

100 parts of silica resulting from treating wet process silica (trade name: NIPGEL AY603, a product TOSOH SILICA Co.) as a pigment to a weight average secondary particle diameter of 6.6 μm and to 47% of the total silica quantity in the number of particles having a weight average secondary particle diameter of not larger than 2 μm by means of a sand mill, 35 parts of silyl-modified PVA (trade name: R-1130, a product of KURARAY Co.) as an adhesive, 5 parts of PVA (trade name: PVA 135, a product of KURARAY Co.), 10 parts of styrene-acryl copolymer resin, 20 parts of acrylamide-diallylamine copolymer (trade name: SR1001, a product of Sumitomo Chemical Co.) as an ink fixing agent, 10 parts diallyldimethyl ammonium chloride (trade name: CP101, a product of SENKA Co.) and water were mixed and dispersed to prepare a coating solution.

[Preparing a Recording Medium for Water-Based Ink]

An ink receptive layer coating solution was applied to one surface of the paper base I so as to give coating quantity of 12 g/m2, then dried, and a recording medium for water-based ink was produced, while setting the time until the start of drying at 5 seconds. The weight of the recording medium was 202 g/m$^2$.

The foregoing various evaluations were made with respect to the recording medium for water-based ink thus produced, the results of which are shown in Table 2. Absorbing speed, absorbing time and absorption quantity in each absorbing stage of the recording medium are in such a relation as indicated by the reference mark A in Table 1 and FIG. 2.

Example 2

A recording medium for water-based ink was produced in the same way as in Example 1 except that the external size in the paper base I prepared in Example 1 was changed to oxidized starch:PVA:styrene-acrylic resin=4: 0.5:0.5 (5% solution) and that the Stöckigt sizing degree was changed to 50 seconds.

The foregoing various evaluations were made with respect to the recording medium for water-based ink thus produced, the results of which are shown in Table 2. Absorbing speed, absorbing time and absorption quantity in each absorbing stage of the recording medium are in such a relation as indicated by the reference mark B in Table 1 and FIG. 2.

Example 3

A recording medium for water-based ink was produced in the same way as in Example 1 except that the pigment contained in the ink receptive layer coating solution was changed to silica resulting from pulverizing wet process silica to a weight average secondary particle diameter of 7.0 μm and to 20% of he total silica quantity in the number of particles having a weight average secondary particle diameter of not larger than 2 μm by means of a sand mill and subsequent classification.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark C in Table 1 and FIG. 2.

Example 4

A recording medium for water-based ink was produced in the same way as in Example 1 except that the weight of the paper base I in Example 1 was changed to 220 g/m$^2$. The weight of the recording medium was 232 g/m$^2$. The results obtained are shown in Table 1.

The foregoing various evaluations were made with respect to the recording medium for water-based ink thus produced, the results of which are shown in Table 2. Absorbing speed, absorbing time and absorption quantity in each absorbing stage of the recording medium are in such a relation as indicated by the reference mark D in Table 1 and FIG. 2.

Example 5

A recording medium for water-based ink was produced in the same way as in Example 1 except that the time until the start of drying in the preparation of the recording medium for water-based ink in Example 1 was changed to 10 seconds.

The foregoing evaluations were made with respect to the recording medium for water-based in thus produced, the results of which are shown in Table 2. Absorbing speed, absorbing time and absorption quantity in each absorbing stage of the recording medium are in such a relation as indicated by the reference mark E in Table 1 and FIG. 2.

Example 6

A recording medium for water-based ink was produced in the same way as in Example 1 except that the time until the start of drying in the preparation of the recording medium for water-based ink in Example 1 was changed to 15 seconds.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark F in Table 1 and FIG. 2.

Example 7

A recording medium for water-based ink was produced in the same way as in Example 1 except that the time until the start of drying in the preparation of the recording medium for water-based ink in Example 1 was changed to 20 seconds.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark G in Table 1 and FIG. 2.

Example 8

A recording medium for water-based ink was produced in the same way as in Example 1 except that the time until the start of drying in the preparation of the recording medium for water-based ink in Example 1 was changed to 25 seconds.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark H in Table 1 and FIG. 2.

Example 9

A recording medium for water-based ink was produced in the same way as in Example 1 except that the time until the start of drying in the preparation of the recording medium for water-based ink in Example 1 was changed to 30 seconds.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark I in Table 1 and FIG. 2.

Comparative Example 1

[Paper Base II]

A 75:25 mixture of light calcium carbonate and kaolin was added to 100 parts of hard wood bleached kraft pulp (freeness 400 ml, CSF: JIS-P-8121), further added were 1.0 part of cation starch, 0.04 part of an alkenyl succinic anhydride-based neutral size and 0.5 part of alum cake, followed by mixing to a thorough extent to prepare a raw material for paper making. With a Fourdrinier multi-cylinder type paper machine, paper making was performed, followed by drying to a water content of 10%. Then, with a size press, a 7% solution of a 5.2:1.3:0.6 mixture of oxidized starch, PVA and styrene-acrylic resin was applied 4 g/m$^2$ to both paper surfaces, followed by drying to a water content of 5.0% to afford a paper base II having a weight of 190 g/m$^2$ and a Stöckigt sizing degree of 300 seconds.

[Preparing a Recording Medium for Water-Based Ink]

A recording medium for water-based ink was produced in the same way as in Example 1 except that the paper base I used in Example 1 was changed to the paper base II.

The foregoing evaluations were made with respect to the recording medium for water-based ink thus produced, the results of which are shown in Table 2. Absorbing speed, absorbing time and absorption quantity in each absorbing stage of the recording medium are in such a relation as indicated by the reference mark J in Table 1 and FIG. 2.

Comparative Example 2

The foregoing evaluations were made with respect to a commercially available mat type recording medium for water-based ink (trade name: Thick Coated Paper, a product of Canon Inc.), the results of which are shown in Table 2. Absorbing speed, absorbing time and absorption quantity of the recording medium are in such a relation as indicated by the reference mark K in Table 1 and FIG. 2.

Comparative Example 3

The foregoing evaluations were made with respect to a commercially available mat type recording medium for water-based ink (trade name: Photo Mat Paper/Pigment Type, a product of EPSON Co.), the results of which are shown in Table 2. Absorbing speed, absorbing time and absorption quantity in each absorbing stage of the recording medium are in such a relation as indicated by the reference numeral L in Table 1 and FIG. 2.

Comparative Example 4

The foregoing evaluations were made with respect to a commercially available mat type recording medium (trade name: PM Mat Paper, a product of EPSON Co.), the results of which are shown in Table 2. Absorbing speed, absorbing time and absorption quantity in each absorbing stage of the recording medium are in such a relation as indicated by the reference mark M in Table 1 and FIG. 2.

TABLE 1

| | First Absorbing Stage | | | Second Absorbing Stage | | | | Third Absorbing Stage | |
|---|---|---|---|---|---|---|---|---|---|
| | | Inflection Point, a | | | Inflection Point, b | | | | Final Point |
| Curve in Graph | V1 Speed (μl/sec) | Time, ta (sec) | Absorption Quantity, qa (μl) | V2 Speed (μl/sec) | Time, tb (sec) | Absorption Quantity, qb (μl) | qb − qa | V3 Speed (μl/sec) | (4 μl) Time, tc (sec) |
| A | 5.63 | 0.3 | 1.69 | 0.17 | 2.6 | 2.08 | 0.39 | 1.28 | 4.1 |
| B | 8.00 | 0.2 | 1.60 | 0.14 | 5.1 | 2.29 | 0.69 | 0.90 | 7.0 |
| C | 8.85 | 0.2 | 1.77 | 0.13 | 3.4 | 2.17 | 0.40 | 1.08 | 5.1 |
| D | 9.40 | 0.2 | 1.88 | 0.18 | 2.5 | 2.30 | 0.42 | 2.43 | 3.2 |
| E | 5.33 | 0.3 | 1.60 | 0.23 | 3.1 | 2.23 | 0.63 | 1.97 | 4.0 |
| F | 6.17 | 0.3 | 1.85 | 0.16 | 3.5 | 2.35 | 0.50 | 1.83 | 4.4 |
| G | 6.50 | 0.3 | 1.95 | 0.12 | 4.1 | 2.42 | 0.47 | 2.63 | 4.7 |
| H | 5.47 | 0.3 | 1.64 | 0.17 | 4.4 | 2.34 | 0.70 | 1.51 | 5.5 |
| I | 5.33 | 0.3 | 1.60 | 0.14 | 6.1 | 2.40 | 0.80 | 1.33 | 7.3 |
| J | 3.60 | 0.3 | 1.08 | 0.01 | 16.9 | 1.30 | 0.22 | 2.45 | 18.0 |
| K | 5.10 | 0.2 | 1.02 | 0.01 | 16.6 | 1.25 | 0.23 | 2.12 | 17.9 |
| L | 3.57 | 0.3 | 1.07 | 0.32 | 4.8 | 2.51 | 1.44 | 0.99 | 6.3 |
| M | 7.37 | 0.3 | 2.21 | 0.10 | 0.6 | 2.24 | 0.03 | 5.87 | 0.9 |

TABLE 2

| | W6200 (Canon Inc.) (Pigment Ink) | | | | PIXUS ip8600 (Canon Inc.) (Dye Ink) | | | |
|---|---|---|---|---|---|---|---|---|
| | Print Density (Black) | Print Density (Magenta) | Boundary Blotting | Image Uniformity | Print Density (Black) | Print Density (Magenta) | Boundary Blotting | Image Uniformity |
| Example 1 | 1.50 | 1.37 | ◎ | ◎ | 1.73 | 1.26 | ○ | ◎ |
| Example 2 | 1.45 | 1.32 | ○ | ◎ | 1.71 | 1.24 | ○ | ◎ |
| Example 3 | 1.46 | 1.32 | ◎ | ◎ | 1.75 | 1.28 | ○ | ◎ |
| Example 4 | 1.48 | 1.34 | ◎ | ◎ | 1.74 | 1.26 | ○ | ◎ |
| Example 5 | 1.49 | 1.32 | ◎ | ◎ | 1.72 | 1.28 | ○ | ◎ |
| Example 6 | 1.48 | 1.33 | ◎ | ◎ | 1.70 | 1.24 | ○ | ◎ |
| Example 7 | 1.47 | 1.35 | ○ | ◎ | 1.70 | 1.23 | ○ | ◎ |
| Example 8 | 1.45 | 1.32 | ○ | ◎ | 1.68 | 1.21 | Δ | ◎ |
| Example 9 | 1.46 | 1.31 | ○ | ◎ | 1.69 | 1.21 | Δ | ◎ |
| Comparative Example 1 | 1.39 | 1.25 | X | X | 1.65 | 1.18 | X | Δ |
| Comparative Example 2 | 1.42 | 1.28 | X | X | 1.70 | 1.20 | X | Δ |
| Comparative Example 3 | 1.38 | 1.26 | Δ | X | 1.71 | 1.21 | Δ | Δ |
| Comparative Example 4 | 1.40 | 1.36 | Δ | X | 1.52 | 1.20 | Δ | Δ |

Solid print portions in Examples and Comparative Examples were observed to find that in Examples 1 to 9 the images were free of unevenness in gloss and clear with respect to both pigment ink and dye ink, but that in Comparative Examples 1 to 4 the images were uneven in gloss and not clear. The ink receptive layers of the recording media in Examples 1 to 9 and Comparative Examples 1 to 4 wee removed with a razor and the presence of silica in the boundary region between the paper base and the ink receptive layer in each recording medium was observed using SEM to find that in Examples 1 to 9 there were silica particles on both paper base side and ink receptive layer side with respect to the boundary interface region between the ink receptive layer and the paper base.

From the Examples and Comparative Examples it is seen that the absorbing speed in the second stage in each of Examples 1 to 9 is not lower than 0.12 μl/sec and not higher than 0.23 μl/sec and is higher than the absorbing speed of 0.01 μl/sec of the reference marks J and K and lower than the absorbing speed of 0.32 μl/sec of the reference mark L. It is also seen that when the absorption quantity qa in the first absorbing state is not smaller than 1.6 μl, the absorbing time (tb−ta) in the second absorbing stage is not shorter than 2 seconds because the absorption quantity is relatively large, but is a relatively short time. Further, the absorption quantity (qb−qa) in the second absorbing stage in each of the Examples is not smaller than 0.39 μl and not larger than 0.80 μl, which is a half or less in comparison with the absorption quantity qa in the first absorbing stage. An explanation will now be given in terms of ink absorption. A relatively large amount of ink is absorbed in a short time in the first absorbing stage, but it is presumed that the absorbed ink performs appropriate retention and movement with little ink blotting and that consequently there is ensured a balance capable of ensuring both improvement of the print density and image clearness. This is apparent from a look at the images obtained. More particularly, the time tb in the second absorbing stage is within the range of 2.5 to 6.1 seconds after the dropping and the time (tb−ta) in the second absorbing stage is not shorter than 2.3 seconds and not longer than 5.8 seconds.

In the above Examples the total weight of both paper base and ink receptive layer is not smaller than 180 g/m$^2$ and not larger than 300 g m$^2$, that is, those working examples are effective for what is called thick paper. On the other hand, the following additional Examples show that the present invention is effective also for recording media of an ordinary thickness. Although in the following Examples there are used thin paper bases, the technical idea of the present invention is independent of thickness and weight and it has been made sure that the effect of each of the foregoing aspects of the present invention can be obtained if the constructional conditions defined therein is satisfied. In this connection, the following Examples are given as typical examples.

[Paper Base III]

In the same manner as in the preparation of the paper base I, 10 parts of calcined kaolin was added to 100 parts of hard wood bleached kraft pulp (freeness 400 ml, CSF: JIS-P-8121), further added were 1.0 part of cation starch, 0.7 part of a rosin size and 2.0 parts of alum cake, followed by mixing to a thorough extent to prepare a raw material for paper making. Then, with a Fourdrinier multi-cylinder type paper machine, paper making was performed, followed by drying to a water content of 10%. Further, with a size press, a 7% aqueous solution of oxidized starch was applied 4 g/m$^2$ to both paper surfaces and dried to a water content of 5.0% to afford a paper base III having a weight of 150 g/m$^2$ and a Stöckigt sizing degree of 10 seconds.

Example 10

A recording medium for water-based ink was produced in the same way as in Example 1 except that the paper base I in Example 1 was changed to the paper base III. The weight of the recording medium for water-based ink thus produced was 162 g/m$^2$.

The foregoing evaluations were made with respect to the recording medium for water-based ink produced above, the results of which are shown in Table 4. Absorbing speed, absorbing time and absorption quantity in each absorbing stage of the recording medium are as indicated by the reference mark N in Table 3 and FIG. 3.

Example 11

A recording medium for water-based ink was produced in the same way as in Example 1 except that the paper base I in Example 1 was changed to the paper base III and that the time until the start of drying was changed to 10 seconds.

The foregoing evaluations were made with respect to the recording medium for water-based ink produced above, the results of which are shown in Table 4. Absorbing speed, absorbing time and absorption quantity in each absorbing state of the recording medium are as indicated by the reference mark O in Table 3 and FIG. 3.

Example 12

A recording medium for water-based ink was produced in the same way as in Example 1 except that the paper base I in Example 1 was changed to the paper base III and that the time until the start of drying was changed to 3 seconds.

The foregoing evaluations were made with respect to the recording medium for water-based in produced above, the results of which are shown in Table 4. Absorbing speed, absorbing time and absorption quantity in each absorbing stage of the recording medium are as indicated by the reference mark P in Table 3 and FIG. 3.

Example 13

A recording medium for water-based ink was produced in the same way as in Example 1 except that the paper base I in Example 1 was changed to the paper base III and that the time until the start of drying was changed to 3 seconds and that the drying temperature was changed to 160° C.

The foregoing evaluations were made with respect to the recording medium for water-based ink thus produced, the results of which are as shown in Table 4. Absorbing speed, absorbing time and absorption quantity in each absorbing stage of the recording medium are as indicated by the reference mark Q in Table 3 and FIG. 3.

Example 14

A recording medium for water-based ink was produced in the same way as in Example 1 except that the paper base I in Example 1 was changed to the paper base III and that the drying temperature was changed to 160° C.

The foregoing evaluations were made with respect to the recording medium for water-based ink, the results of which are shown in Table 4. Absorbing speed, absorbing time and absorption quantity in each absorbing stage of the recording medium are as indicated by the reference mark R in Table 3 and FIG. 3.

Example 15

In the same manner as in the preparation of the paper base I, 10 parts of calcined kaolin was added to 100 parts of hard wood bleached kraft pulp (freeness 400 ml, CSF: JIS-P-8121), then further added were 1.0 part of cation starch, 0.7 part of a rosin size and 2.0 parts of alum cake, followed by mixing to a thorough extent to prepare a raw material for paper making. Then, with a Fourdrinier multi-cylinder paper machine, paper making was performed, followed by drying to a water content of 10%. Further, with a size press, a 7% aqueous solution of oxidized starch was applied 4 g/m$^2$ to both paper surfaces, followed by drying to a water content of 5.0% to afford a paper base IV having a weight of 127 g/m$^2$ and a Stöckigt sizing degree of 9 seconds.

A recording medium for water-based ink was produced in the same manner as in Example 1 except that the paper base I in Example 1 was changed to the paper base IV. The weight of the recording medium was 139 g/m$^2$.

The foregoing evaluations were made with respect to the recording medium for water-based ink thus produced, the results of which are shown in Table 4. Absorbing speed, absorbing time and absorption quantity in each absorbing stage of the recording medium are in such a relation as indicated by the reference mark S in Tale 3 and FIG. 3.

Example 16

A recording medium for water-based ink was produced in the same way as in Example 1 except that the paper base I in Example 1 was changed to the paper base IV and that the time until the start of drying was changed to 10 seconds.

The foregoing evaluations were made with respect to the recording medium for water-based in thus produced, the results of which are shown in table 4. Absorbing speed, absorbing time and absorption quantity in each absorbing stage of the recording medium are in such a relation as indicated by the reference mark T in Table 3 and FIG. 3.

Example 17

A recording medium for water-based ink was produced in the same way as in Example 1 except that the paper base I in Example 1 was changed to the paper base IV and that the time until the start of drying was changed to 3 seconds.

The foregoing evaluations were made with respect to the recording medium for water-base thus produced, the results of which are shown in Table 4. Absorbing speed, absorbing time and absorption quantity in each stage of the recording medium are in such a relation as indicated by the reference mark U in Table 3 and FIG. 3.

Example 18

A recording medium for water-based ink was produced in the same way as in Example 1 except that the paper support I in Example 1 was changed to the paper base IV and that the time until the start of drying was changed to 3 seconds and the drying time changed to 160° C.

The foregoing evaluations were made with respect to the recording medium for water-based ink thus produced, the results of which are shown in Table 4. Absorbing speed, absorbing time and absorption quantity in each stage of the recording medium are in such a relation as indicated by the reference mark V in Table 3 and FIG. 3.

Example 19

A recording medium for water-based ink was produced in the same way as in Example 1 except that the paper base I in Example 1 was changed to the paper base IV and that the drying temperature was changed to 160° C.

The foregoing evaluations were made with respect to the recording medium for water-based ink thus produced, the results of which are shown in Table 4. Absorbing speed, absorbing time and absorption quantity in each absorbing stage of the recording medium are in such a relation as indicated by the reference mark W in Table 3 and FIG. 3.

TABLE 3

| | First Absorbing Stage | | | Second Absorbing Stage | | | | Third Absorbing Stage | |
|---|---|---|---|---|---|---|---|---|---|
| | | Inflection Point, a | | | Inflection Point, b | | | | Final Point |
| Curve in Graph | V1 Speed (μl/sec) | Time, ta (sec) | Absorption Quantity, qa (μl) | V2 Speed (μl/sec) | Time, tb (sec) | Absorption Quantity, qb (μl) | qb − qa | V3 Speed (μl/sec) | (4 μl) Time, tc (sec) |
| N | 4.42 | 0.4 | 1.59 | 0.08 | 10.6 | 2.42 | 0.83 | 3.16 | 11.1 |
| O | 3.87 | 0.4 | 1.47 | 0.06 | 11.5 | 2.17 | 0.70 | 3.05 | 12.1 |
| P | 4.75 | 0.3 | 1.52 | 0.08 | 12.5 | 2.49 | 0.97 | 2.52 | 13.1 |
| Q | 3.78 | 0.4 | 1.36 | 0.07 | 12.5 | 2.22 | 0.86 | 2.97 | 13.1 |
| R | 3.69 | 0.4 | 1.33 | 0.08 | 11.1 | 2.18 | 0.85 | 4.55 | 11.5 |
| S | 4.06 | 0.3 | 1.38 | 0.09 | 9.6 | 2.23 | 0.85 | 4.43 | 10.0 |
| T | 4.84 | 0.3 | 1.55 | 0.07 | 11.5 | 2.28 | 0.73 | 2.87 | 12.1 |
| U | 4.16 | 0.3 | 1.33 | 0.08 | 12.1 | 2.28 | 0.95 | 4.30 | 12.5 |
| V | 3.84 | 0.4 | 1.46 | 0.05 | 13.5 | 2.14 | 0.68 | 3.10 | 14.1 |
| W | 4.06 | 0.3 | 1.30 | 0.08 | 12.1 | 2.28 | 0.98 | 4.30 | 12.5 |
| J | 3.60 | 0.3 | 1.08 | 0.01 | 16.9 | 1.30 | 0.22 | 2.45 | 18.0 |
| K | 5.10 | 0.2 | 1.02 | 0.01 | 16.6 | 1.25 | 0.23 | 2.12 | 17.9 |
| L | 3.57 | 0.3 | 1.07 | 0.32 | 4.8 | 2.51 | 1.44 | 0.99 | 6.3 |
| M | 7.37 | 0.3 | 2.21 | 0.10 | 0.6 | 2.24 | 0.03 | 5.87 | 0.9 |

TABLE 4

| | W6200 (Canon Inc.) | | | | PIXUS ip8600 (Canon Inc.) | | | |
|---|---|---|---|---|---|---|---|---|
| | Print Density (Black) | Print Density (Magenta) | Boundary Blotting | Image Uniformity | Print Density (Black) | Print Density (Magenta) | Boundary Blotting | Image Uniformity |
| Example 10 | 1.49 | 1.34 | ◎ | ◎ | 1.71 | 1.26 | ○ | ◎ |
| Example 11 | 1.46 | 1.32 | ◎ | ◎ | 1.70 | 1.26 | ○ | ◎ |
| Example 12 | 1.45 | 1.31 | ○ | ◎ | 1.69 | 1.24 | ○ | ◎ |
| Example 13 | 1.45 | 1.30 | ○ | ◎ | 1.70 | 1.25 | ○ | ◎ |
| Example 14 | 1.47 | 1.31 | ◎ | ◎ | 1.70 | 1.26 | ○ | ◎ |
| Example 15 | 1.47 | 1.33 | ◎ | ◎ | 1.71 | 1.25 | ○ | ◎ |
| Example 16 | 1.46 | 1.32 | ◎ | ◎ | 1.70 | 1.25 | ○ | ◎ |
| Example 17 | 1.45 | 1.31 | ○ | ◎ | 1.70 | 1.24 | ○ | ◎ |
| Example 18 | 1.44 | 1.30 | ○ | ◎ | 1.69 | 1.23 | ○ | ◎ |
| Example 19 | 1.45 | 1.32 | ○ | ◎ | 1.69 | 1.23 | ○ | ◎ |

From the above Examples it is seen that in the case where qa (not smaller than 1.3 μl) in the first absorbing stage in the present invention is smaller than 1.60 μl, the absorption quantity in the first absorbing stage is relatively small, and that therefore a colorant fixing corresponding to an image density can be effected by setting the absorption quantity (qb−qa) in the second absorbing stage at a relatively long and gentle absorption. More specifically, it is preferable that the occurrence of tb as the start time in the third absorbing stage be not shorter than 9.5 seconds and that the absorbing speed V2 in the second absorbing stage be not lower than 0.01 μl/sec and lower than 0.12 μl/sec. In N, O, P, Q, R, S, T, U, V and W, the tb in the second absorbing stage is not shorter than 9.6 seconds and not longer than 13.5 seconds and the absorbing speed V2 is not lower than 0.05 μl/sec and not higher than 0.09 μl/sec. This condition is more effective for the present invention. Particularly, this range indicates that the present invention is effective for a recording medium having a weight of not smaller than 130 g/m$^2$ and smaller than 180 g/m$^2$, i.e., having an ordinary thickness.

From the above Tables 1 to 4 it is seen that in the Examples of the present invention the absorbing speed V2 in the second absorbing stage is higher than the absorbing speed, 0.01 μl/sec, of J and K and lower than the absorbing speed, 0.32 μl/sec of L. More particularly, the absorbing speeds of A, B, C, D, E, F, G, H and I are twelve to seventeen times higher than the absorbing speed of J and K and are about half of the absorbing speed of L. In N, O, P, Q, R, S, T, U, V and W, the absorbing speeds in the second absorbing stage are five to eight times higher than the absorbing speed of J and K and are about one-sixth to one-fourth of the absorbing speed of L. That is, the "moderate" speed as referred to herein is not lower than 0.05 μl/sec and not higher than 0.23 μl/sec. This condition is more effective for the present invention.

As described above, the effect of the present invention is obtained independently of thickness and weight when a droplet of 4 μl distilled water dropped onto the surface of the ink receptive layer is absorbed in the first absorbing stage of absorbing the droplet at the first absorbing speed V1 (μl/sec) within one second after the dropping, the second absorbing stage of absorbing the droplet at the second absorbing speed V2 (μl/sec) for at least 2 seconds after the first absorbing stage, and the third absorbing stage of absorbing the droplet at the third absorbing speed V3 (μl/sec) after the second absorbing stage, the droplet absorption in the first to third absorbing stages satisfying the following relationships:

$$0<V2<V1$$

$$0<V2<V3,$$

and given that an inflection point from the first to the second absorbing stage is a, an inflection point from the second to the third absorbing stage is b, a final point of the third absorbing stage is c, absorption quantities at the points a, b and c are qa, qb and qc, respectively, and the times up to the points a, b and c are ta, tb and tc, respectively, the absorption quantity qa at the inflection point a is not smaller than 1.3 μl and smaller than 2.0 μl, the absorption quantity qb at the inflection point b is larger than the absorption quantity qa in the first absorbing stage and smaller than 2.5 μl, and the absorption quantity (qb−qa) in the second absorbing stage is not smaller than 0.3 μl and not larger than 1.4 μl.

Further, it has turned out that when the second absorbing stage occurs after 9.5 seconds after the dropping of the droplet and the time tc up to the final point in the third absorbing stage occurs within 14.5 seconds after the dropping, the effect of the present invention is obtained to a satisfactory extent even in the case of a system having a thin paper base.

Figure 1:
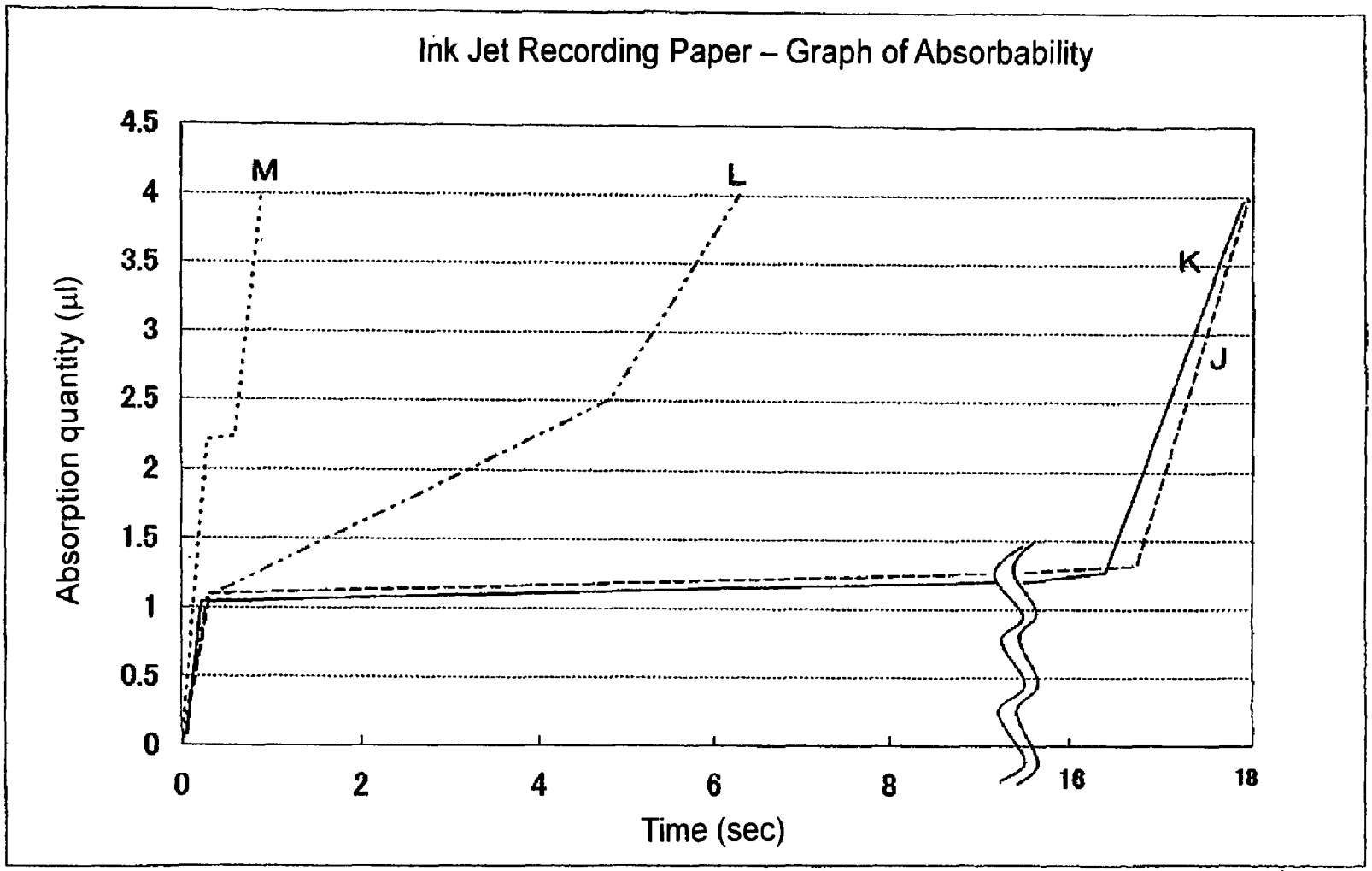
FIG. 1 is an explanatory diagram showing characteristics of conventional recording media as determined by the determining method according to the present invention.
Figure 2:
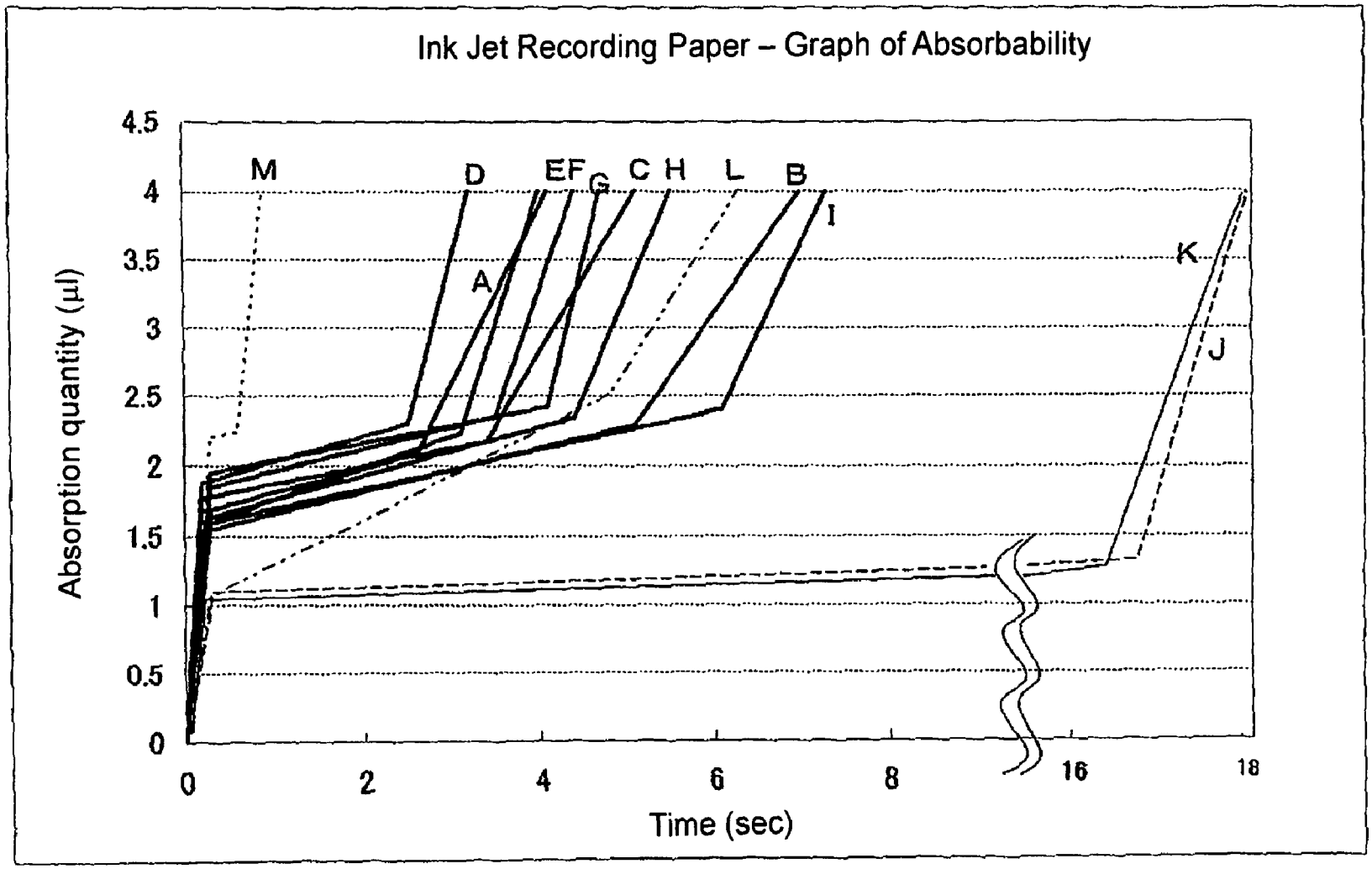
FIG. 2 is an explanatory diagram graphically showing absorption characteristics of recording media according to an embodiment of the present invention.
Figure 3:
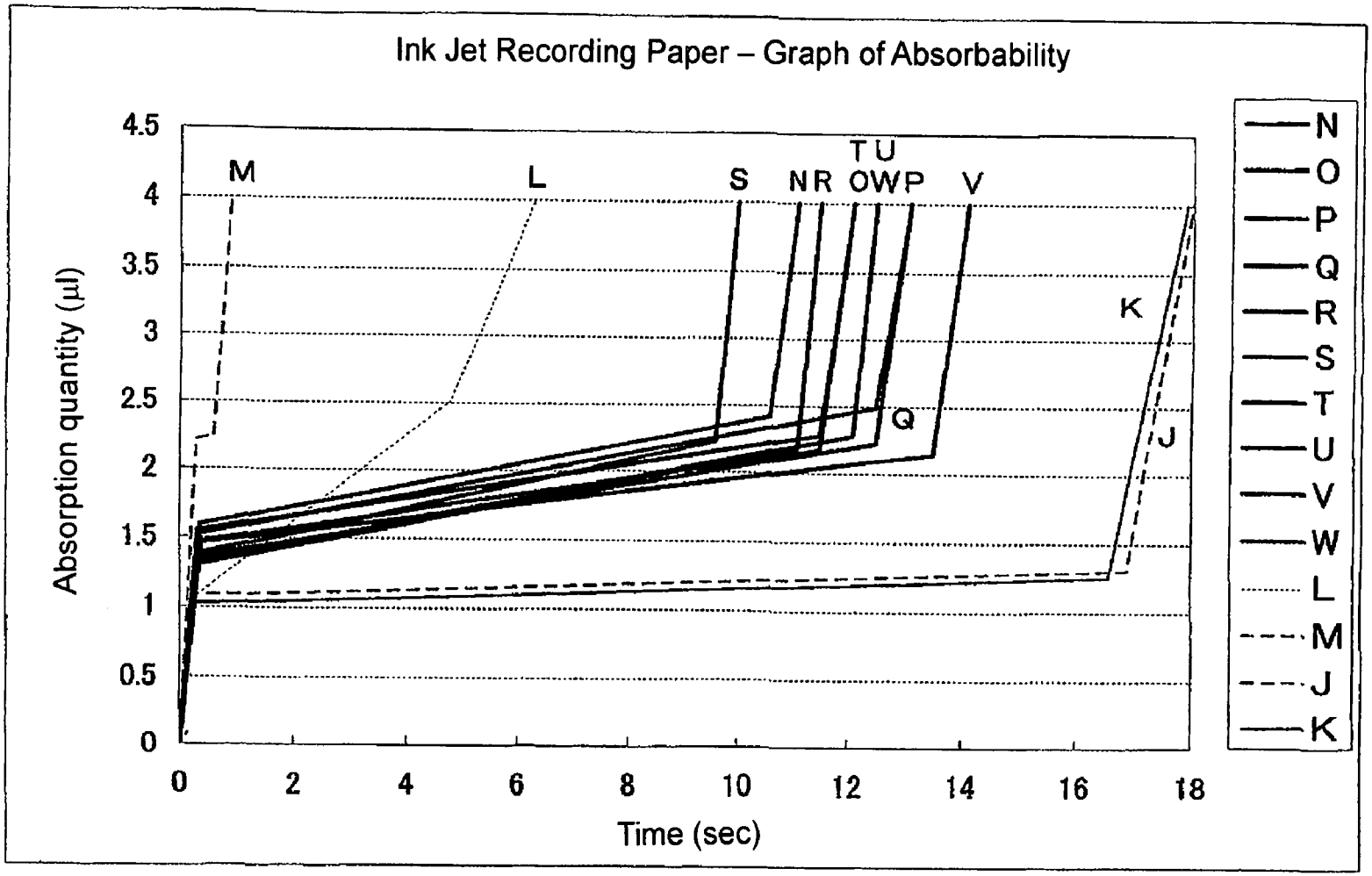
FIG. 3 is an explanatory diagram graphically showing absorption characteristics of recording media according to another embodiment of the present invention.

In the drawings, the reference mark A stands for an absorbing speed of a recording medium for water-based ink produced in Example 1, B stands for an absorbing speed of a recording medium for water-based ink produced in Example 2, C stands for an absorbing speed of a recording medium for water-based ink produced in Example 3, D stands for an absorbing speed of a recording medium for water-based ink produced in Example 4, E stands for an absorbing speed of a recording medium for water-based ink produced in Example 5, F stands for an absorbing speed of a recording medium for water-based ink produced in Example 6, G stands for an absorbing speed of a recording medium for water-based ink produced in Example 7, H stands for an absorbing speed of a recording medium for water-based ink produced in Example 8, I stands for an absorbing speed of a recording medium for water-based ink produced in Example 9, J stands for an absorbing speed of a recording medium for water-based ink produced in Comparative Example 1, K stands for an absorbing speed of a recording medium for water-based ink produced in Comparative Example 2, L stands for an absorbing speed of a recording medium for water-based ink produced in Comparative Example 3, M stands for an absorbing speed of a recording medium for water-based ink produced in Comparative Example 4, N stands for an absorbing speed of a recording medium for water-based ink produced in Example 10, O stands for an absorbing speed of a recording ink for water-based ink produced in Example 11, P stands for an absorbing speed of a recording medium for water-based ink produced in Example 12, Q stands for an absorbing speed of a recording medium for water-based ink produced in Example 13, R stands for an absorbing speed of a recording medium for water-based ink produced in Example 14, S stands for an absorbing speed of a recording medium for water-based ink produced in Example 15, T stands for an absorbing speed of a recording medium for water-based ink produced in Example 16, U stands for an absorbing speed of a recording medium for water-based ink produced in Example 17, V stands for an absorbing speed of a recording medium for water-based ink produced in Example 18, and W stands for an absorbing speed of a recording medium for water-based ink produced in Example 19.

What is claimed is:

1. A recording medium for water-based ink, comprising a paper base and an ink receptive layer formed on a surface of said paper base, the ink receptive layer comprising a porous layer containing an inorganic pigment and also containing a substance reactive with an ink colorant, the recording medium being to be recorded using water-based ink containing the ink colorant, wherein:

a droplet of 4 μl distilled water dropped onto a surface of the ink receptive layer is absorbed in a first absorbing stage of absorbing the droplet at a first absorbing speed (V1) (μl/sec) within one second after the dropping, a second absorbing stage of absorbing the droplet at a second absorbing speed (V2) (μl/sec) for at least 2 seconds after the first absorbing stage, and a third absorbing stage of absorbing the droplet at a third absorbing speed (V3) (μl/sec) after the second absorbing stage, the droplet absorption in the first to third absorbing stages satisfying the following relationships:

$$0<V2<V1$$

$$0<V2<V3,$$

the second absorbing speed (V2) (μl/sec) being higher than 0.01 (μl/sec) and lower than 0.32 (μl/sec), and given that an inflection point from the first to the second absorbing stage is (a), an inflection point from the second to the third absorbing stage is (b), a final point of the third absorbing stage is (c), absorption quantities at the points (a), (b) and (c) are (qa), (qb) and (qc), respectively, and the times up to the points (a), (b) and (c) are (ta), (tb) and (tc), respectively, the absorption quantity (qa) at the inflection point, (a), is not smaller than 1.3 μl and smaller than 2.0 μl, and the absorption quantity (qb) at the inflection point, (b), is not smaller than 2.0 μl and smaller than 2.5 μl, wherein the ink receptive layer has a $pH_B$ satisfying the following relationship:

$$5<pH_B\leqq 7$$

and the paper base has a $pH_A$ and the ink receptive layer has the $pH_B$ both satisfying the following relationship:

$$1<(pH_B-pH_A)<4.$$

2. A recording medium for water-based ink as set forth in claim 1, wherein the inflection point, (a), occurs within 0.5 second after the dropping.

3. A recording medium for water-based ink as set forth in claim 1, wherein the absorption quantity (qb−qa) in the second absorbing state is not smaller than 0.3 μl and not larger than 1.2 μl.

4. A recording medium for water-based ink as set forth in claim 1, wherein the absorption quantity (qb−qa) in the second absorbing stage is not smaller than 0.5 μl and not larger than 1.0 μl.

5. A recording medium for water-based ink as set forth in claim 1, wherein the absorption quantity (qa) at the inflection point, (a), is not smaller than 1.5 μl.

6. A recording medium for water-based ink as set forth in claim 5, wherein the weight of the recording medium is not less than 180 g/m$^2$ and not more than 300 g/m$^2$, and the inflection point, (b), occurs within 8 seconds after the dropping.

7. A recording medium for water-based ink as set forth in claim 1, wherein the paper base has a Stöckigt sizing degree of not shorter than 5 seconds and not longer than 50 seconds.

8. A recording medium for water-based ink as set forth in claim 1, wherein the second absorbing speed (V2) (μl/sec) is higher than 0.05 (μl/sec) and lower than 0.23 (μl/sec).

9. A recording medium for water-based ink as set forth in claim 1, wherein the second absorbing speed (V2) (μl/sec) is higher than 0.12 (μl/sec) and lower than 0.23 (μl/sec).

10. A recording medium for water-based ink, comprising a paper base, the paper base having a Stöckigt sizing degree of not shorter than 5 seconds and not longer than 50 seconds, and an ink receptive layer formed on a surface of the paper base, the ink receptive layer containing amorphous silica, an adhesive and a substance reactive with an ink colorant, wherein:

a droplet of 4 μl distilled water dropped onto a surface of the ink receptive layer is absorbed in a first absorbing state of absorbing the droplet at a first absorbing speed (V1) (μl/sec) within one second after the dropping, a second absorbing stage of absorbing the droplet at a second absorbing speed (V2) (μl/sec) for at least 2 seconds after the first absorbing stage, and a third absorbing stage of absorbing the droplet at a third absorbing speed (V3) (μl/sec) after the second absorbing stage and within 8 seconds after the dropping, the droplet absorption in the first to third absorbing stages satisfying the following relationship:

$$0<V2<V3<V1,$$

the second absorbing speed (V2) (μl/sec) being higher than 0.01 (μl/sec) and lower than 0.32 (μl/sec), and given that an inflection point from the first to the second absorbing stage is (a), an inflection point from the second to the third absorbing stage is (b), a final point of the third absorbing stage is (c), absorption quantities at the points (a), (b) and (c) are (qa), (qb) and (qc), respectively, and the times up to the points (a), (b) and (c) are (ta), (tb) and (tc), respectively, the absorption quantity (qa) at the inflection point, (a), is not smaller than 1.5 μl and not larger than 2.0 μl and the absorption quantity (qb−qa) in the second absorbing stage is not smaller than 0.3 μl and not larger than 1.0 μl, wherein the ink receptive layer has a $pH_B$ satisfying the following relationship:

$$5<pH_B\leqq 7,$$

the paper base has a $pH_A$ and the ink receptive layer has the $pH_B$ both satisfying the following relationship:

$$1<(pH_B-pH_A)<4,$$

the ink receptive layer has a thickness of not smaller than 25 μm and not larger than 35 μm, and the weight of the paper base and the ink receptive layer is in the range of not smaller than 180 g/m$^2$ and not larger than 300 g/m$^2$.

11. A recording medium for water-based ink as set forth in claim 10, wherein the second absorbing speed (V2) (μl/sec) is higher than 0.12 (μl/sec) and lower than 0.23 (μl/sec).

12. A recording medium for water-based ink to be recorded using water-based ink containing an anion colorant, the recording medium having on a surface of a paper base an ink receptive layer, the ink receptive layer comprising a porous layer containing an inorganic pigment and a substance reactive with the ink colorant, wherein:

a droplet of 4 μl distilled water dropped onto a surface of the ink receptive layer is absorbed in a first absorbing stage of absorbing the droplet at a first absorbing speed (V1) (μl/sec) within one second after the dropping, a second absorbing stage of absorbing the droplet at a second absorbing speed (V2) (μl/sec) for not shorter than 2 seconds after the first absorbing stage, and a third absorbing stage of absorbing the droplet at a third absorbing speed (V3) (μl/sec) after the second absorbing stage, the droplet absorption in the first to third absorbing stages satisfying the following relationships:

$$0<V2<V1$$

$$0<V2<V3,$$

the second absorbing speed (V2) (μl/sec) being higher than 0.01 (μl/sec) and lower than 0.32 (μl/sec), and given that an inflection point from the first to the second absorbing stage is (a), an inflection point from the second to the third absorbing stage is (b), a final point of the third absorbing stage is (c), absorption quantities at the points (a), (b) and (c) are (qa), (qb) and (qc), respectively, and the times up to the points (a), (b) and (c) are (ta), (tb) and (tc), respectively, the absorption quantity qa at the inflection point, (a), is not smaller than 1.3 μl and not larger than 2.0 μl, and the absorption quantity (qb−qa) in the second absorbing stage is not smaller than 0.3 μl and not larger than 1.0 μl, wherein the ink receptive layer has a $pH_B$ satisfying the following relationship:

$$5<pH_B\leqq 7,$$

the paper base has a $pH_A$ and the ink receptive layer has the $pH_B$ both satisfying the following relationship:

$$1<(pH_B-pH_A)<4,$$

the ink receptive layer has a thickness of not smaller than 25 μm and not larger than 35 μm, and the weight of the paper base and the ink receptive layer is in the range of not smaller than 180 g/m$^2$ and not larger than 300 g/m$^2$.

13. A recording medium for water-based ink as set forth in claim 12, wherein the second absorbing speed (V2) (μl/sec) is higher than 0.05 (μl/sec) and lower than 0.23 (μl/sec).

14. A recording medium for water-based ink as set forth in claim 13, wherein the paper base has a Stöckigt sizing degree of not shorter than 5 seconds and not longer than 50 seconds.

15. A recording medium for water-based ink, comprising a paper base and an ink receptive layer formed on a surface of the paper base, the ink receptive layer containing amorphous silica, an adhesive and a substance reactive with an ink colorant, wherein:

a droplet of 4 μl distilled water dropped onto a surface of the ink receptive layer is absorbed in a first absorbing stage of absorbing the droplet at a first absorbing speed (V1) (μl/sec) within one second after the dropping, a second absorbing stage of absorbing the droplet at a second absorbing speed (V2) (μl/sec) for at least 2 seconds after the first absorbing stage, and a third absorbing stage of absorbing the droplet at a third absorbing speed (V3) (μl/sec) after the second absorbing stage, the droplet absorption in the first to third absorbing stages satisfying the following relationships:

$$0<V2<V1$$

$$0<V2<V3,$$

the second absorbing speed (V2) (μl/sec) being higher than 0.01 (μl/sec) and lower than 0.32 (μl/sec), and given that an inflection point from the first to the second absorbing stage is (a), an inflection point from the second to the third absorbing stage is (b), a final point of the third absorbing stage is (c), absorption quantities at the points (a), (b) and (c) are (qa), (qb) and (qc), respectively, and the times up to the points (a), (b) and (c) are (ta), (tb) and (tc), respectively, the absorption quantity (qa) at the inflection point, (a), is not smaller than 1.3 μl and smaller than 2.0 μl, the absorption quantity (qb) at the inflection point, (b), is larger than the absorption quantity (qa) in the first absorbing stage and smaller than 2.5 μl, and the absorption quantity (qb−qa) in the second absorbing stage is not smaller than 0.3 μl and not larger than 1.4 μl, wherein the ink receptive layer has a $pH_B$ satisfying the following relationship:

$$5<pH_B\leqq 7,$$

the paper base has a $pH_A$ and the ink receptive layer has the $pH_B$ both satisfying the following relationship:

$$1<(pH_B-pH_A)<4,$$

the ink receptive layer has a thickness of not smaller than 25 μm and not larger than 35 μm, and the weight of the paper base and the ink receptive layer is in the range of not smaller than 180 g/m$^2$ and not larger than 300 g/m$^2$.

16. A recording medium for water-based ink as set forth in claim 15, wherein the absorption quantity (qb−qa) in the second absorbing stage is not smaller than 0.38 μl and not larger than 1.0 μl.

17. A recording medium for water-based ink as set forth in claim 16, wherein the absorption quantity (qa) at the inflection point, (a), is not smaller than 1.5 μl.

18. A recording medium for water-based ink as set forth in claim 15, wherein the second absorbing stage occurs within not shorter than 2.0 seconds and not longer than 13.5 seconds after the dropping of the droplet.

19. A recording medium for water-based ink as set forth in claim 18, wherein the time (tc) in the third absorbing stage is within 14.1 seconds after the dropping of the droplet.

20. A recording medium for water-based ink as set forth in claim 17, wherein the second absorbing stage occurs within 6.1 seconds after the dropping of the droplet and the time (tc) up to the final point in the third absorbing stage occurs within 8 seconds after the dropping of the droplet.

21. A recording medium for water-based ink as set forth in claim 16, wherein the second absorbing stage occurs at or after 9.5 seconds from dropping of the droplet and the time (tc) up to the final point in the third absorbing stage occurs within 14.5 seconds after the dropping of the droplet.

22. A recording medium for water-based ink as set forth in claim 15, wherein the second absorbing speed V2 (μl/sec) is higher than 0.05 (μl/sec) and lower than 0.23 (μl/sec).

23. A recording medium for water-based ink as set forth in claim 20, wherein the second absorbing speed (V2) (μl/sec) is higher than 0.12 (μl/sec) and lower than 0.23 (μl/sec).

24. A recording medium for water-based ink as set forth in claim 21, wherein the second absorbing speed is higher than 0.05 (μl/sec) and lower than 0.09 (μl/sec).

* * * * *